US012491397B2

(12) United States Patent
Garcia et al.

(10) Patent No.: US 12,491,397 B2
(45) Date of Patent: Dec. 9, 2025

(54) WEIGHTLIFTING BARBELL

(71) Applicant: Coulter Ventures, LLC., Columbus, OH (US)

(72) Inventors: Nicolas Garcia, Centerburg, OH (US); William Henniger, Columbus, OH (US); Ahmik Jones, Upper Arlington, OH (US); Martin Pritchett, Columbus, OH (US); Charlie Tighe, Columbus, OH (US); Thomas Brown, Orient, OH (US)

(73) Assignee: Coulter Ventures, LLC., Columbus, OH (US)

( * ) Notice: Subject to any disclaimer, the term of this patent is extended or adjusted under 35 U.S.C. 154(b) by 220 days.

(21) Appl. No.: 18/104,919

(22) Filed: Feb. 2, 2023

(65) Prior Publication Data

US 2023/0241445 A1 Aug. 3, 2023

Related U.S. Application Data

(60) Provisional application No. 63/393,076, filed on Jul. 28, 2022, provisional application No. 63/322,022, (Continued)

(51) Int. Cl.
*A63B 21/072* (2006.01)
*A63B 21/00* (2006.01)

(52) U.S. Cl.
CPC ..... *A63B 21/0724* (2013.01); *A63B 21/4035* (2015.10)

(58) Field of Classification Search
CPC ..... A63B 21/0724; A63B 21/4035; A63B 21/4049; A63B 2210/50
See application file for complete search history.

(56) References Cited

U.S. PATENT DOCUMENTS 2,722,419 A 11/1955 Tarapczynski
3,998,454 A 12/1976 Jones
(Continued)

FOREIGN PATENT DOCUMENTS

CN 2493246 Y 5/2002
CN 303000699 11/2014
(Continued)

OTHER PUBLICATIONS

Product listing for Rogue TB-1 Trap Bar 2.0, from <https://web.archive.org/web/20170424054849/https://www.roguefitness.com/rogue-tb-1-trap-bar-2-0>, dated Apr. 24, 2017, product known to be available prior to Feb. 1, 2022.
(Continued)

*Primary Examiner* — Andrew M Kobylarz
(74) *Attorney, Agent, or Firm* — Banner & Witcoff, Ltd.

(57) ABSTRACT

A barbell includes a central section having opposed ends, a mounting structure including first and second tubular members located at the ends of the central section and engaged with the first tubular member, and a second barbell section engaged with the second tubular member. The first barbell section includes a first bar portion having a first sleeve mounted thereon, and the first bar portion has a first proximal end received in the first central passage and connected to the first tubular member to connect the first barbell section to one end of the central section. The second barbell section includes a second bar portion having a second sleeve rotatably mounted thereon, and the second bar portion has a second proximal end received in the second central passage and connected to the second tubular member to connect the second barbell section to the other end of the central section.

28 Claims, 39 Drawing Sheets

Related U.S. Application Data filed on Mar. 21, 2022, provisional application No. 63/305,951, filed on Feb. 2, 2022.

(56) References Cited

U.S. PATENT DOCUMENTS

| | | | | |
|---|---|---|---|---|
| 4,018,442 | A | 4/1977 | Galler | |
| 4,274,628 | A | 6/1981 | Hoagland | |
| D261,788 | S | 11/1981 | Burns | |
| 4,461,473 | A * | 7/1984 | Cole | A63B 21/0724 482/106 |
| D284,930 | S | 8/1986 | Richards | |
| 4,605,222 | A | 8/1986 | Shannon | |
| 4,743,018 | A | 5/1988 | Eckler | |
| D302,195 | S | 7/1989 | Orak | |
| 4,858,917 | A | 8/1989 | Montgomery | |
| 4,863,158 | A | 9/1989 | Tassone | |
| 4,872,667 | A | 10/1989 | Favot | |
| 4,903,962 | A | 2/1990 | Pollack | |
| D317,641 | S | 6/1991 | Gerard | |
| D320,249 | S | 9/1991 | Gerard | |
| D320,636 | S | 10/1991 | Eckler | |
| D324,894 | S | 3/1992 | Porcello | |
| D328,112 | S | 7/1992 | Maddix et al. | |
| 5,221,244 | A | 6/1993 | Doss | |
| 5,269,737 | A | 12/1993 | Sobotka | |
| 5,679,105 | A | 10/1997 | Vittone et al. | |
| D390,615 | S | 2/1998 | Stutsman | |
| 5,725,461 | A | 3/1998 | Bogard, II | |
| 5,836,858 | A | 11/1998 | Sharff | |
| 6,004,245 | A | 12/1999 | Boos | |
| D425,151 | S | 5/2000 | Landfair | |
| D433,468 | S | 11/2000 | Rojas et al. | |
| D437,015 | S | 1/2001 | Rojas et al. | |
| D464,691 | S | 10/2002 | Tracy | |
| D480,438 | S | 10/2003 | Walkow | |
| 6,663,542 | B1 | 12/2003 | Trabbic | |
| 6,679,815 | B2 | 1/2004 | Vittone et al. | |
| 6,945,918 | B1 | 9/2005 | Hill | |
| D520,575 | S | 5/2006 | Diakonov et al. | |
| 7,056,268 | B2 | 6/2006 | Emick | |
| 7,094,182 | B1 | 8/2006 | Holten | |
| D532,465 | S | 11/2006 | Mills et al. | |
| D535,336 | S | 1/2007 | Diakonov et al. | |
| D626,187 | S | 10/2010 | Friedman et al. | |
| D647,580 | S | 10/2011 | Cen | |
| D671,996 | S | 12/2012 | Wierszewski | |
| D685,865 | S | 7/2013 | Kuhn | |
| 8,556,781 | B1 | 10/2013 | Fitzpatrick | |
| 8,602,951 | B2 | 12/2013 | Morris | |
| 8,951,170 | B1 * | 2/2015 | Tayo | A63B 21/0728 482/139 |
| D725,722 | S | 3/2015 | Conaway | |
| 8,974,351 | B2 | 3/2015 | Wallisch | |
| D731,008 | S | 6/2015 | Orakwusi | |
| 9,254,408 | B1 | 2/2016 | Otto | |
| 9,254,410 | B1 | 2/2016 | Mirza | |
| D750,472 | S | 3/2016 | Kuka | |
| 9,364,703 | B1 | 6/2016 | Kuka | |
| 9,364,704 | B1 | 6/2016 | Kuka | |
| D763,166 | S | 8/2016 | Berson | |
| D767,692 | S | 9/2016 | Kuka | |
| D767,693 | S | 9/2016 | Kuka | |
| D776,209 | S | 1/2017 | Gilbert | |
| 9,724,556 | B1 | 8/2017 | Otto | |
| D797,217 | S | 9/2017 | Gilbert | |
| 9,833,654 | B1 | 12/2017 | Gant et al. | |
| D808,474 | S | 1/2018 | Tochigi | |
| 9,855,460 | B2 | 1/2018 | Wilson | |
| D811,497 | S | 2/2018 | Petek | |
| 9,889,330 | B2 | 2/2018 | Mann | |
| D816,782 | S | 5/2018 | Petek | |
| D823,953 | S | 7/2018 | Kuka | |
| D834,660 | S | 11/2018 | Petek | |
| D836,172 | S | 12/2018 | Kuka | |
| D839,974 | S | 2/2019 | Jessup | |
| D842,947 | S | 3/2019 | Kuka | |
| D843,506 | S | 3/2019 | Campanaro et al. | |
| D843,512 | S | 3/2019 | Petek | |
| D845,404 | S | 4/2019 | Kuka | |
| D851,186 | S | 6/2019 | Kuka | |
| D855,126 | S | 7/2019 | Kuka | |
| D855,720 | S | 8/2019 | Kuka | |
| 10,583,317 | B2 | 3/2020 | Amyan | |
| D888,166 | S * | 6/2020 | Henniger | D21/679 |
| 10,695,604 | B2 | 6/2020 | Porterfield | |
| D889,570 | S | 7/2020 | Petek | |
| D890,957 | S | 7/2020 | Kuka | |
| 10,773,116 | B2 | 9/2020 | Vanderbleek | |
| D898,134 | S | 10/2020 | Hitman | |
| 10,799,752 | B1 | 10/2020 | Mattox et al. | |
| D908,818 | S | 1/2021 | Barton et al. | |
| 10,881,893 | B2 | 1/2021 | Welde et al. | |
| 10,888,730 | B2 | 1/2021 | Rella | |
| 10,888,731 | B2 * | 1/2021 | Olmstead | A63B 21/0724 |
| 10,953,270 | B2 | 3/2021 | Fazzari | |
| D916,214 | S | 4/2021 | Gonzales | |
| D919,018 | S | 5/2021 | Kuka | |
| 11,103,741 | B2 | 8/2021 | Leoniak | |
| 11,235,192 | B1 | 2/2022 | Thomas | |
| 11,241,601 | B2 * | 2/2022 | Sorin | A63B 21/0728 |
| D956,889 | S | 7/2022 | Marrs | |
| 11,426,621 | B2 | 8/2022 | Bauerle | |
| D973,155 | S | 12/2022 | Gong | |
| 11,517,783 | B2 | 12/2022 | Hamady | |
| D974,506 | S | 1/2023 | Qi | |
| 11,590,384 | B2 | 2/2023 | Hurlbut | |
| 11,648,438 | B2 * | 5/2023 | Bauerle | A63B 21/0724 482/45 |
| 11,679,296 | B2 | 6/2023 | Cotton | |
| D995,668 | S | 8/2023 | Bodnár | |
| 11,865,404 | B2 | 1/2024 | Hitman | |
| D1,026,132 | S * | 5/2024 | Henniger | D21/679 |
| D1,029,144 | S * | 5/2024 | Larson | D21/679 |
| D1,040,945 | S | 9/2024 | Zhang | |
| D1,061,752 | S * | 2/2025 | Pritchett | D21/679 |
| 2006/0040802 | A1 | 2/2006 | Vittone et al. | |
| 2007/0287611 | A1 * | 12/2007 | Januszek | A63B 21/0728 482/107 |
| 2014/0243166 | A1 * | 8/2014 | Lister | A63B 21/0601 264/319 |
| 2016/0051857 | A1 | 2/2016 | Rasner | |
| 2017/0106226 | A1 | 4/2017 | Mann | |
| 2017/0120104 | A1 | 5/2017 | Douglass et al. | |
| 2018/0126211 | A1 | 5/2018 | Chen | |
| 2018/0243605 | A1 | 8/2018 | Light et al. | |
| 2019/0030388 | A1 | 1/2019 | Williams | |
| 2019/0247703 | A1 | 8/2019 | Welde et al. | |
| 2020/0061407 | A1 | 2/2020 | LaCroce | |
| 2020/0230457 | A1 * | 7/2020 | Vanderbleek | A63B 23/0405 |
| 2021/0178214 | A1 * | 6/2021 | Garcia | A63B 21/0724 |
| 2021/0178218 | A1 * | 6/2021 | Sorin | A63B 21/0728 |
| 2023/0241445 | A1 | 8/2023 | Garcia et al. | |
| 2023/0398398 | A1 * | 12/2023 | Pizer | A63B 21/4039 |
| 2024/0139575 | A1 * | 5/2024 | Johnston | A63B 21/4035 |
| 2024/0198165 | A1 * | 6/2024 | Hitman | A63B 21/0724 |

FOREIGN PATENT DOCUMENTS

| | | | | |
|---|---|---|---|---|
| CN | 305014912 | | 1/2019 | |
| CN | 305403149 | | 10/2019 | |
| CN | 305870499 | | 6/2020 | |
| CN | 306012859 | | 8/2020 | |
| CN | 306329944 | | 2/2021 | |
| EP | 3583984 | A1 | 12/2019 | |
| FR | 2735986 | A1 * | 1/1997 | A63B 21/072 |
| GB | 2297273 | A | 7/1996 | |
| GB | 3016630 | | 4/2004 | |
| GB | 2499828 | A | 9/2013 | |
| GB | 6019368 | | 9/2017 | |
| GB | 6232791 | | 10/2022 | |
| GB | 6251835 | | 1/2023 | |
| JP | 3077683 | B2 | 8/2000 | |
| JP | D1143102 | | 6/2002 | |
| JP | 2007301073 | A | 11/2007 | |

(56) References Cited

FOREIGN PATENT DOCUMENTS

| | | | |
|---|---|---|---|
| JP | 2009240337 | A | 10/2009 |
| KR | 300908163.0000 | | 5/2017 |
| KR | 300908660.0000 | | 6/2017 |
| KR | 300910885.0000 | | 6/2017 |
| KR | 300910886.0000 | | 6/2017 |
| KR | 300914316.0000 | | 7/2017 |
| WO | 201127078 | A1 | 3/2011 |
| WO | 13013358 | A1 | 1/2013 |

OTHER PUBLICATIONS

Photos of Rogue TB-1 Trap Bar 2.0, from <https://web.archive.org/web/20170424054849/https://www.roguefitness.com/rogue-tb-1-trap-bar-2-0>, dated Apr. 24, 2017.
Product listing for Rogue TB-2 Trap Bar, from <https://web.archive.org/web/20170425134451/https://www.roguefitness.com/rogue-tb-2-trap-bar>, dated Apr. 25, 2017.
Photos of Rogue TB-2 Trap Bar, from <https://web.archive.org/web/20170425134451/https://www.roguefitness.com/rogue-tb-2-trap-bar>, dated Apr. 25, 2017.
Rogue TB-1 by Rogue dated Apr. 16, 2015. Found online [Apr. 16, 2019] (Year: 2015).
Hex bar by Black Widow dated no date given. Found online [Apr. 16, 2019] (Year: 0).
Hex bar black by dated Oct. 24, 2017. Found online [Apr. 16, 2019] (Year: 2017).
Cap Barbell by Amazon dated Mar. 12, 2019 Found online [Apr. 16, 2019] (Year: 2019).
Apex legends, announced 2005 [online], [site visited May 3, 2021]. Available on internet, URL:https://www.amazon.com/Triceps-Weightlifting-Strength-Training-Accessory/dp/B000ASB66Y/ref=sr_1_11?dchild=1&keywords=curl+bar&qid=1619655628&sr-8-11 (Year: 2005).
Marcy store, announced 2007 [online], [site visited May 3, 2021]. Available on internet, URL:https://www.amazon.com/Marcy-Threaded-Standard-Weightlifting-Accessory/dp/B0012ZE8QY/ref=pd (Year 2007).
Product listing for SB-1—Rogue Safety Squat Bar, From:http://web.archive.org/web/20180830072617/https:/www.roguefitness.com/sb-1-rogue-safety-squat-bar, dated Jun. 30, 2014, accessed Jun. 22, 2021.
Product listing for CB-1 Rogue Camber Bar From http://web.archive.org/web/20180724100528/https:/www.roguefitness.com/cb-1-rogue-camber-bar, dated Jun. 23, 2014, accessed Jun. 22, 2021.
"Olympic Open Trap Bar / Hex Bar"; Bells of Steel; retrieved Feb. 9, 2022; disclosure date unknown but prior to Feb. 2, 2022; URL: <https://www.bellsofsteel.us/all-products/barbells/specialty-barbells/trap-bar-hex-bar/?utm_source=Google+Shopping&utm_medium=cpc&utm_campaign=google-shopping-feed-us&gclid=EAIalQobChMI-6WFo4bx9QIVi7jICh2VdQc5EAQYBCABEgJIG_D_BwE>.
"The Kadillac Bar"; Kabuki Strength; retrieved Mar. 28, 2022; published Sep. 11, 2020; URL: <https://store.kabukistrength.net/products/the-kadillac-bar>.
"Arch Nemesis Swiss Bar"; Arch Nemesis Swiss Bar; retrieved Mar. 28, 2022; disclosure date unknown but prior to Feb. 2, 2022; URL: <https://www.bellsofsteel.us/all-products/barbells/specialty-barbells/swiss-bar/>.
Product listing for Rogue MG-1 Multi Grip Bar 2.0, From:https://www.roguefitness.com/rogue-mg-1-multi-grip-bar-2-0, dated Dec. 1, 2015, accessed Mar. 28, 2022.
Product listing for Rogue MG-2 Multi Grip Bars, From:https://www.roguefitness.com/rogue-mg-2-multi-grip-bars, dated May 17, 2015, accessed Mar. 28, 2022.
Product listing for Rogue MG-3 Multi Grip Bar, From:https://www.roguefitness.com/rogue-mg-3-multi-grip-bar, dated Jun. 27, 2015, accessed Mar. 28, 2022.
Product listing for Rogue TB-1 Trap Bar 2.0, From: https://www.roguefitness.com/rogue-tb-1-trap-bar-2-0, dated Sep. 5, 2015, accessed Mar. 28, 2022.
Product listing for Rogue TB-2 Trap Bar, From: https://www.roguefitness.com/rogue-tb-2-trap-bar, dated Jun. 16, 2015, accessed Mar. 28, 2022.
Product listing for Rogue MG-3 Multi Grip Bar from: <https://www.roguefitness.com/rogue-mg-3-multi-grip-bar>, dated Jun. 27, 2015.
Product listing for Rogue MG-2 Multi Grip Bars from: <https://www.roguefitness.com/rogue-mg-2-multi-grip-bars>, dated May 17, 2015.
Product listing for Rogue MG-1 Multi Grip Bar 2.0 from: <https://www.roguefitness.com/rogue-mg-1-multi-grip-bar-2-0>, dated Dec. 1, 2015.
"The Pentagon Bar Review—What Coaches Should Know"; Simpli faster; retrieved Oct. 27, 2022; FALSEdisclosure date unknown but prior to the filing date of the present application; URL: <https://simplifaster.com/articles/pentagon-bar-coaches-review/>.
Product listing for LB-3 Rogue 12" Log Bar, From: https://www.roguefitness.com/lb-3-rogue-12-log-bar, dated Mar. 12, 2015, accessed Nov. 28, 2022.
Product listing for LB-1 Rogue 10" Log Bar, From: https://www.roguefitness.com/log-bar, dated Jun. 15, 2014, accessed Nov. 28, 2022.
Product listing for LB-2 Rogue 8" Log Bar, From: https://www.roguefitness.com/lb-2-rogue-8-log-bar, dated Jun. 27, 2014, accessed Nov. 28, 2022.
"Rogue MG-4F Multi Grip Bar", Sep. 2022, Rogue Fitness, site visited May 26, 2023: https://www.roguefitness.com/ <http://www.roguefitness.com/> rogue-mg-4f-multi-grip-bar (Year: 2022).
Rogue MG-4C Multi Grip Camber Bar, Rogue Fitness, as shown in www. <http://www/>roguefitness.com, May 2022. (Year: 2022).
Titan Multi-Grip Camber Bar, as sown in www.titan.fitness.com, <http://www.titan.fitness.com/>approximately Oct. 2018. (Year: 2018).
Catalog for "Power Systems Sports 2007 Catalogue", p. 68, publication date unknown but prior to the filing date of the present application (1 page).
MG-4CN Narrow Multi Grip Camber Bar_ Rogue Fitness, as shown in www.roguefitness.com, <http://www.roguefitness.com/>Aug. 2022. (Year: 2022).
"Kadillac Bar for a Pain Free Bench Press" Nov. 21, 2019, Youtube, site visited Apr. 7, 2024:https://www.youtube.com/watch?v=i7Jjvz20aQ (Year: 2019).
"It's Confession Time . . . ", Oct. 10, 2021, Youtube, site visited Apr. 7, 2024:https://www.youtube.com/watch?v=VHwN8LR91Uk ( Year: 2021).
"How We Built the REP Cambered Swiss Bar | REP Engineering" Jan. 21, 2022, Youtube, site visited Sep. 5, 2024: <https://www.youtube.com/watch?v=7zUoleAZmVE> (Year: 2022).
Titan Fitness Rackable Multi-Grip Camber Olympic Barbell, Rated 1,000 LB, Angled & Neutral Grip Football Barbell, ASIN B07H4WNKNK, Date First Available Aug. 23, 2018. (Year: 2018).
Titan Fitness Hybrid Angled Multi-Grip Olympic Barbell V3, Rated 1,900 LB, Rackable Swiss/Football Bar, ASIN B0BJ7KR2Z1, as shown in www.amazon.com, Date First Available Oct. 14, 2022. (Year: 2022).
Arch Nemesis Swiss Bar [Bells of Steel] Robust Bench Press Bar I Cambered Bench Press Bar, Tricep Bar and Cable Attachment I Multi Grip Bar Design—600lb Weight Capacity, ASIN B09TVGST2N, as shown in www.amazon.com, Mar. 4, 2022. (Year: 2022).
Yes4All Multi Grip Barbell & Cable Attachment—Swiss Bar, American Bar for Greater Range of Motion, with 2 Collars, Fits Olympic Weight Plates—Home Gym & Support Pressing, Lifting & Curls, ASIN BO?JB92L9K, as shown in www.amazon.com, Date First Available Oct. 12, 2018. (Year: 2018).
Rogue MG-4CN Narrow Multi Grip Camber Bar, as shown in www.roguefitness.com, earliest customer review, Jan. 16, 2024. (Year: 2024).
"Titan Fitness Rackable Strongman Log Bars" Apr. 27, 2021, Amazon, site visited Oct. 2, 2024:https://www.amazon.com/Titan-Fitness-Strongman-Powerl ifting-Weightlifting/dp/B093LVDTBL/ref=asc_df_B093LVDTBL/?t=undefined&th=1&psc=1 (Year: 2021).
"Strongman Rogue Log Press 240 x Aug. 3, 2014" Aug. 5, 2014, Youtube, site visited Oct. 2, 2024:https://www.youtube.com/watch?v=6owxrX5J0Nk (Year: 2014).

(56) References Cited

OTHER PUBLICATIONS

"Danielle Rideout Rogue Strongman Log" Jul. 29, 2012, Youtube, site visited Oct. 2, 2024:https://www.youtube.com/watch?v=XnHGe1bca1Q (Year: 2012).
"LB-1 Rogue 10" Log Bar AU" Sep. 2014, Rogue Fitness, site visited Oct. 2, 2024:https://www.rogueaustralia.com.au/log-bar-au (Year: 2014).
"LB-1 Rogue 1O" Log Bar CA" Mar. 2013, Rogue Fitness, site visited Oct. 2, 2024:https://www.roguecanada.ca/log-bar ( Year: 2013).
"Riot Competition Steel Strongman Log" Jun. 7, 2021, Strength Shop, site visited Oct. 2, 2024:https://www.strengthshop.ie/products/strength-shop-steel-strongman-log (Year: 2021).

* cited by examiner

WEIGHTLIFTING BARBELL

CROSS-REFERENCE TO RELATED APPLICATION

This application claims priority to and is a nonprovisional of U.S. Provisional Application No. 63/305,951, filed Feb. 2, 2022; U.S. Provisional Application No. 63/322,022, filed Mar. 21, 2022; and U.S. Provisional Application No. 63/393,076, filed Jul. 28, 2022, which prior applications are incorporated by reference herein in their entireties.

BACKGROUND

A large number of barbells exist for use in various weightlifting exercises, including barbells having specialized gripping configurations. These specialized barbells include barbells with multiple grips at multiple different widths and/or angles. However, existing specialized barbells typically use fixed sleeves for mounting of weight plates and do not provide satisfactory options for use of high-quality rotating barbell sleeves. Such sleeves are desirable to many users, particularly users who engage in weightlifting frequently and/or lift large amounts of weight. Existing specialized barbells also fail to provide a configuration that can be shipped in a manageable package and easily assembled to provide a strong and reliable product. Further, the configurations of some specialized barbells may benefit from specific weighting configurations that are not provided by existing barbells.

The present disclosure is provided to address this need and other needs in existing barbells. A full discussion of the features and advantages of the present invention is deferred to the following detailed description, which proceeds with reference to the accompanying drawings.

BRIEF SUMMARY

Aspects of the disclosure relate to a barbell including a central section with a frame including a plurality of frame members extending between opposed first and second ends of the central section, a mounting structure comprising a first tubular member located at the first end of the central section, the first tubular member having a first central passage, and a second tubular member located at the second end of the central section, the second tubular member having a second central passage, a first barbell section connected to the first tubular member, and a second barbell section connected to the second tubular member. The first and second central passages each have a tapered inner diameter that decreases from an outer end toward an inner end thereof. The first barbell section includes a first bar portion having a first sleeve mounted thereon, the first bar portion having a first proximal end received in the first central passage and connected to the first tubular member to connect the first barbell section to the first end of the central section, where the first bar portion is tapered to have a narrower diameter toward the first proximal end. The second barbell section includes a second bar portion having a second sleeve mounted thereon, the second bar portion having a second proximal end received in the second central passage and connected to the second tubular member to connect the second barbell section to the second end of the central section, where the second bar portion is tapered to have a narrower diameter toward the second proximal end.

According to one aspect, the barbell also includes a plurality of grip members connected to the frame and configured for gripping by a user.

According to another aspect, the central section further includes a first end piece connected to the frame at the first end of the central section, and a second end piece connected to the frame at the second end of the central section, where the first tubular member is engaged with the first end piece, and the second tubular member is engaged with the second end piece. In one configuration, the first tubular member extends through the first end piece, and the second tubular member extends through the second end piece According to a further aspect, the mounting structure further includes a first brace member connected to the first tubular member at a first location spaced inwardly from the first end piece and further connected to the central section to support the first tubular member, and a second brace member connected to the second tubular member at a second location spaced inwardly from the second end piece and further connected to the central section to support the second tubular member.

According to yet another aspect, the first sleeve is rotatably mounted on the first bar portion, and the second sleeve is rotatably mounted on the second bar portion. In another configuration, the first and second sleeves may be fixedly mounted on the first and second bar portions, respectively.

According to a still further aspect, the first central passage extends from the inner end to the outer end of the first tubular member and the second central passage extends from the inner end to the outer end of the second tubular member. In one configuration, the first proximal end extends through the first central passage for connection to a first removable fastener at the inner end of the first tubular member to removably connect the first bar portion to the first tubular member, and the second proximal end extends through the second central passage for connection to a second removable fastener at the inner end of the second tubular member to removably connect the second bar portion to the second tubular member.

According to an additional aspect, the first bar portion is tapered to match the tapered inner diameter of the first central passage, and the second bar portion is tapered to match the tapered inner diameter of the second central passage.

According to another aspect, the barbell has a longitudinal axis defined between the first and second ends, and the plurality of frame members include a first longitudinal member and a second longitudinal member extending along the longitudinal axis on opposite lateral sides of the central section.

Additional aspects of the disclosure relate to a barbell including a central section having a frame including a plurality of frame members extending between opposed first and second ends of the central section, a first end piece connected to the frame at the first end of the central section, and a second end piece connected to the frame at the second end of the central section, a mounting structure including a first tubular member located at the first end of the central section and a second tubular member located at the second end of the central section, a first barbell section connected to the first tubular member, and a second barbell section connected to the second tubular member. The first tubular member has a first central passage, and the second tubular member has a second central passage. The first tubular member is engaged with the first end piece and extends through the first end piece, and the second tubular member is engaged with the second end piece and extends through the second end piece. The mounting structure further includes a first brace member connected to the first tubular member at a first location spaced inwardly from the first end piece and further connected to the central section to support the first tubular member, and a second brace member connected to the second tubular member at a second location spaced inwardly from the second end piece and further connected to the central section to support the second tubular member. The first barbell section includes a first bar portion having a first sleeve mounted thereon, the first bar portion having a first proximal end received in the first central passage and connected to the first tubular member to connect the first barbell section to the first end of the central section. The second barbell section includes a second bar portion having a second sleeve mounted thereon, the second bar portion having a second proximal end received in the second central passage and connected to the second tubular member to connect the second barbell section to the second end of the central section.

According to one aspect, the barbell further includes a plurality of grip members connected to the frame and configured for gripping by a user.

According to another aspect, the first sleeve is rotatably mounted on the first bar portion, and the second sleeve is rotatably mounted on the second bar portion. In another configuration, the first and second sleeves may be fixedly mounted on the first and second bar portions, respectively.

According to another aspect, the first tubular member extends through a first circular opening through the first end piece, and the second tubular member extends through a second circular opening through the second end piece.

According to a further aspect, the first central passage extends from an inner end to an outer end of the first tubular member and the second central passage extends from an inner end to an outer end of the second tubular member. In one configuration, the first proximal end extends through the first central passage for connection to a first removable fastener at the inner end of the first tubular member to removably connect the first bar portion to the first tubular member, and the second proximal end extends through the second central passage for connection to a second removable fastener at the inner end of the second tubular member to removably connect the second bar portion to the second tubular member.

According to yet another aspect, the barbell has a longitudinal axis defined between the first and second ends, and the plurality of frame members include a first longitudinal member and a second longitudinal member extending along the longitudinal axis on opposite lateral sides of the central section. In one configuration, the first brace member is connected to the first and second longitudinal members. In another configuration, the plurality of frame members further includes a first angled member extending from the first longitudinal member to the first end piece, a second angled member extending from the first longitudinal member to the second end piece, a third angled member extending from the second longitudinal member to the first end piece, a fourth angled member extending from the second longitudinal member to the second end piece. In this configuration, the first, second, third, and fourth angled members are angled laterally and longitudinally inward from the first and second longitudinal members. Additionally, in this configuration, the first brace member may be connected to the first angled member and the third angled member, and the second brace member may be connected to the second angled member and the fourth angled member.

According to a still further aspect, the first and second central passages each have a tapered inner diameter that decreases from an outer end toward an inner end thereof. In this configuration, the first bar portion is tapered to have a narrower diameter toward the first proximal end, and the second bar portion is tapered to have a narrower diameter toward the second proximal end.

According to an additional aspect, the plurality of frame members form a first side portion and a second side portion extending between the first and second ends of the central section. In this configuration, the first brace member is connected to the first side portion and the second side portion, and the second brace member is connected to the first side portion and the second side portion.

Further aspects of the disclosure relate to a barbell including a central section having a frame including a plurality of frame members forming a first side portion and a second side portion extending between opposed first and second ends of the central section, a first end piece connected to the frame at the first end of the central section, and a second end piece connected to the frame at the second end of the central section, a mounting structure comprising a first tubular member located at the first end of the central section and a second tubular member located at the second end of the central section, a first barbell section connected to the first tubular member, a second barbell section connected to the second tubular member, and a plurality of grip members connected to the frame and configured for gripping by a user. The first tubular member has a first central passage extending from an inner end to an outer end thereof, and the second tubular member has a second central passage extending from an inner end to an outer end thereof. The first tubular member is engaged with the first end piece and extends through the first end piece, and the second tubular member is engaged with the second end piece and extends through the second end piece. The first and second central passages each have a tapered inner diameter that decreases from the outer end to the inner end thereof. The mounting structure further includes first brace members each connected to the first tubular member at a first location spaced inwardly from the first end piece and further connected to the central section to support the first tubular member and second brace members each connected to the second tubular member at a second location spaced inwardly from the second end piece and further connected to the central section to support the second tubular member. The first barbell section includes a first bar portion having a first sleeve mounted thereon, the first bar portion having a first proximal end received in the first central passage and extending through the first central passage for connection to a first removable fastener to removably connect the first bar portion to the first tubular member, thereby connecting the first barbell section to the first end of the central section. The first bar portion is tapered to have a narrower diameter toward the first proximal end and to match the tapered inner diameter of the first central passage. The second barbell section includes a second bar portion having a second sleeve mounted thereon, the second bar portion having a second proximal end received in the second central passage and extending through the second central passage for connection to a second removable fastener to removably connect the second bar portion to the second tubular member, thereby connecting the second barbell section to the second end of the central section. The second bar portion is tapered to have a narrower diameter toward the second proximal end and to match the tapered inner diameter of the first central passage.

According to one aspect, each of the plurality of grip members is connected to the first side portion and the second side portion of the frame and extends between the first and second side portions.

According to another aspect, the first brace members extend from the first tubular member to the first and second side portions of the frame, and the second brace members extend from the second tubular member to the first and second side portions.

According to a further aspect, the first and second side portions of the frame each include a longitudinal frame member extending linearly along a longitudinal axis of the barbell.

According to yet another aspect, the frame has an arched configuration that arches upward from the first and second ends toward a longitudinal middle of the frame.

According to a still further aspect, the frame is configured as a trap bar.

Still further aspects of the disclosure relate to a barbell including a central section having opposed first and second ends, a mounting structure including a first tubular member located at the first end of the central section, the first tubular member having a first central passage, and a second tubular member located at the second end of the central section, the second tubular member having a second central passage, a first barbell section engaged with the first tubular member, and a second barbell section engaged with the second tubular member. The first barbell section includes a first bar portion having a first sleeve mounted thereon, and the first bar portion has a first proximal end received in the first central passage and connected to the first tubular member to connect the first barbell section to the first end of the central section. The second barbell section includes a second bar portion having a second sleeve mounted thereon, and the second bar portion has a second proximal end received in the second central passage and connected to the second tubular member to connect the second barbell section to the second end of the central section. Any of the various aspects discussed herein may be included.

Other aspects of the disclosure relate to a kit including a barbell according to any aspects discussed herein, where the first barbell section and the second barbell section are provided separately from the central section and the mounting structure.

Additional aspects of the disclosure relate to a barbell including a central section having opposed first and second ends and a mounting structure including a first tubular member located at the first end of the central section, the first tubular member having a first central passage, and a second tubular member located at the second end of the central section, the second tubular member having a second central passage. The first tubular member and the second tubular member are configured to receive proximal ends of a first barbell section and a second barbell section to connect the first and second barbell sections to the central section. The barbell may include any aspects and embodiments discussed herein.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
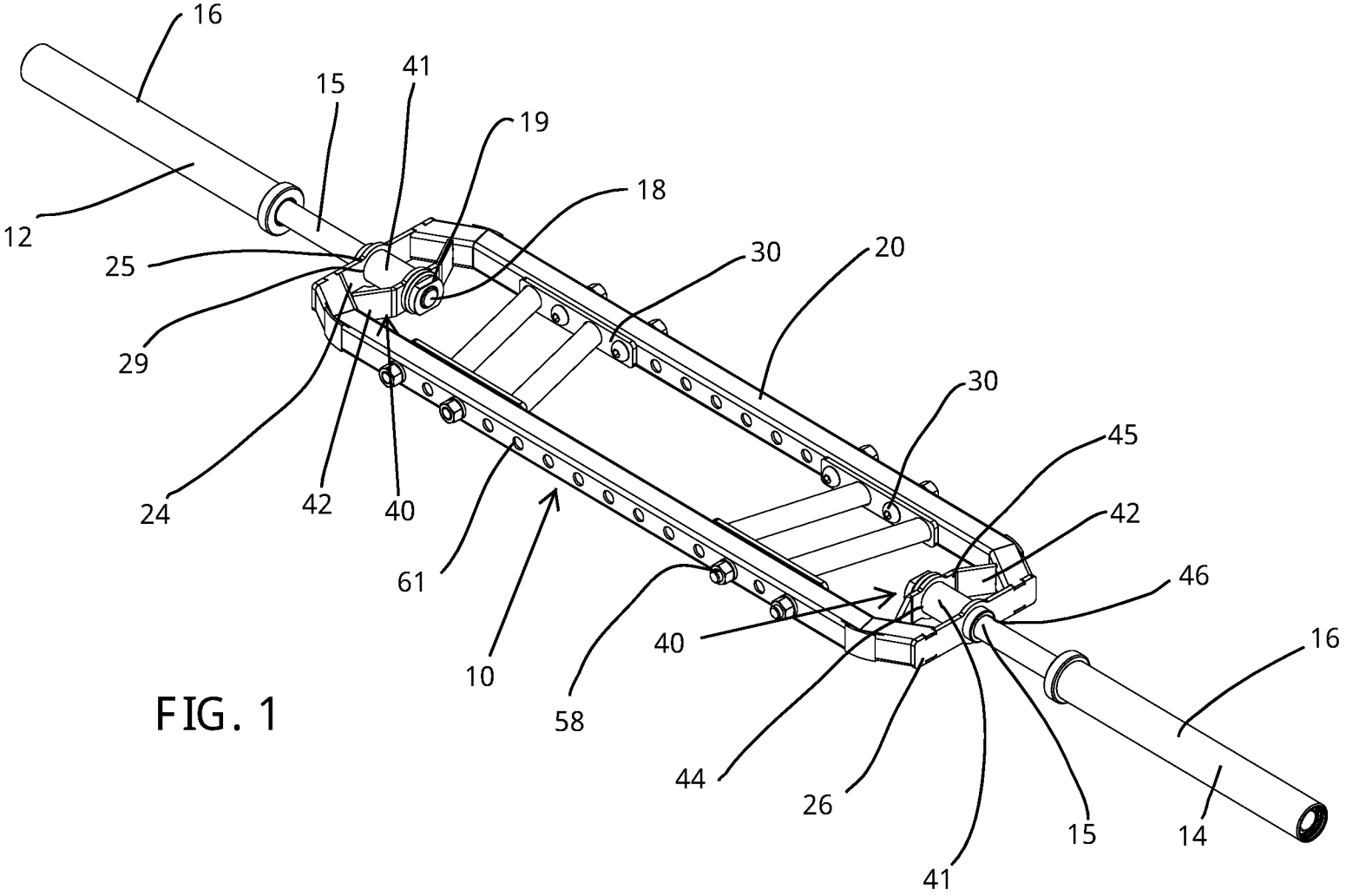
FIG. 1 is a perspective view of one embodiment of a barbell according to aspects of the present disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 2:
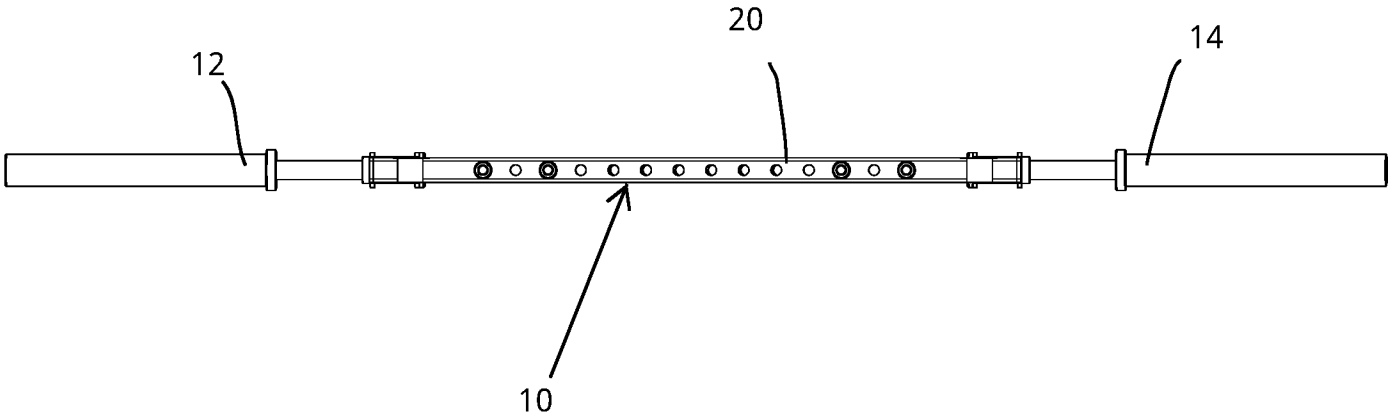
FIG. 2 is a front view of the barbell of FIG. 1.
Figure 3:
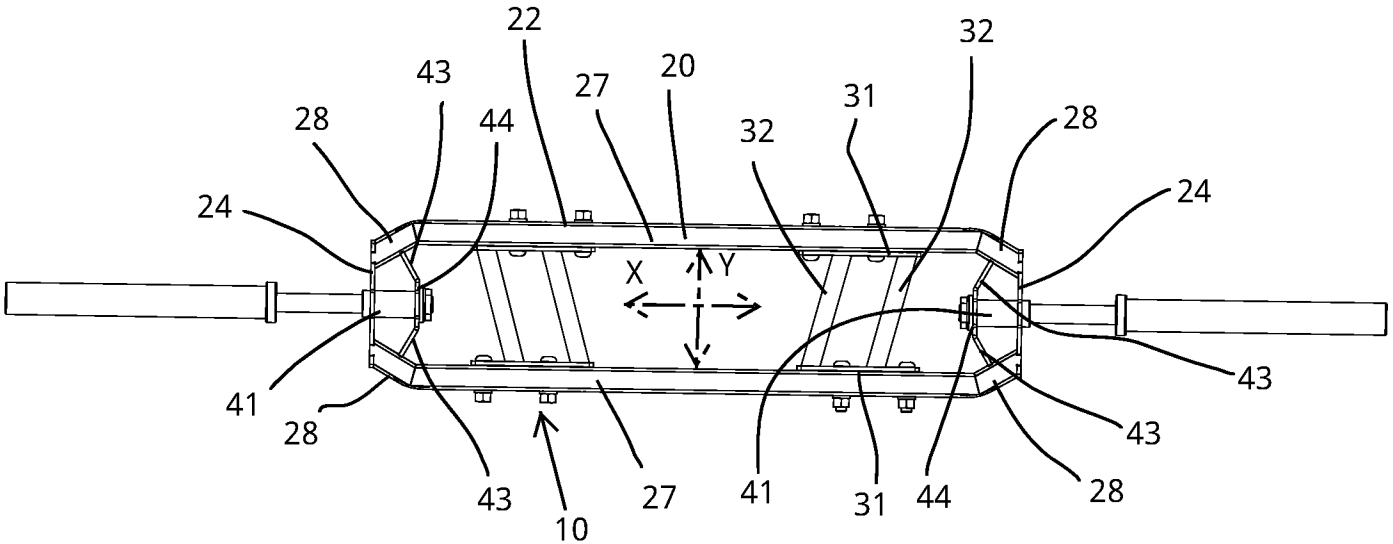
FIG. 3 is a top view of the barbell of FIG. 1.
Figure 4:
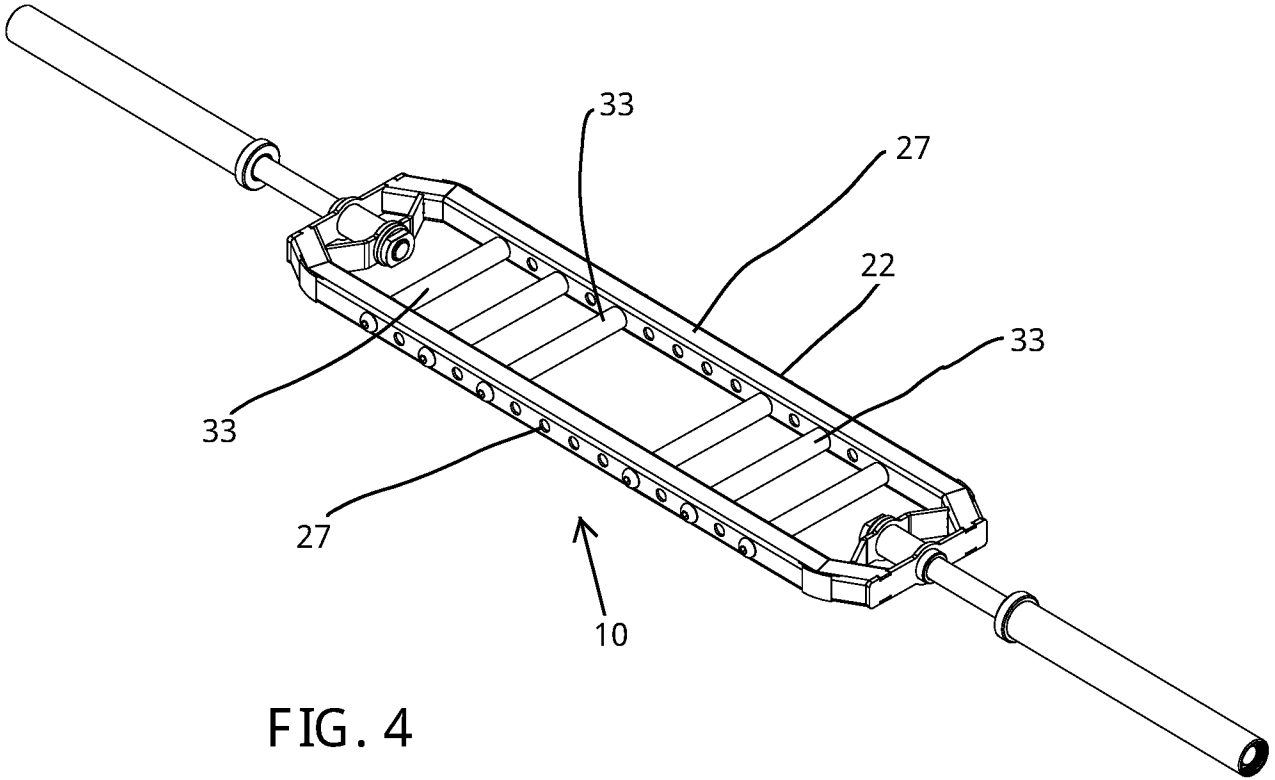
FIG. 4 is a perspective view of another embodiment of a barbell according to aspects of the present disclosure.
Figure 5:
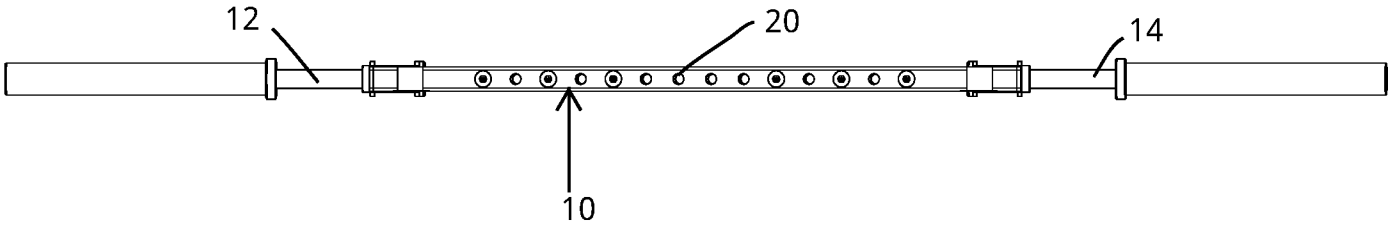
FIG. 5 is a front view of the barbell of FIG. 4.
Figure 6:
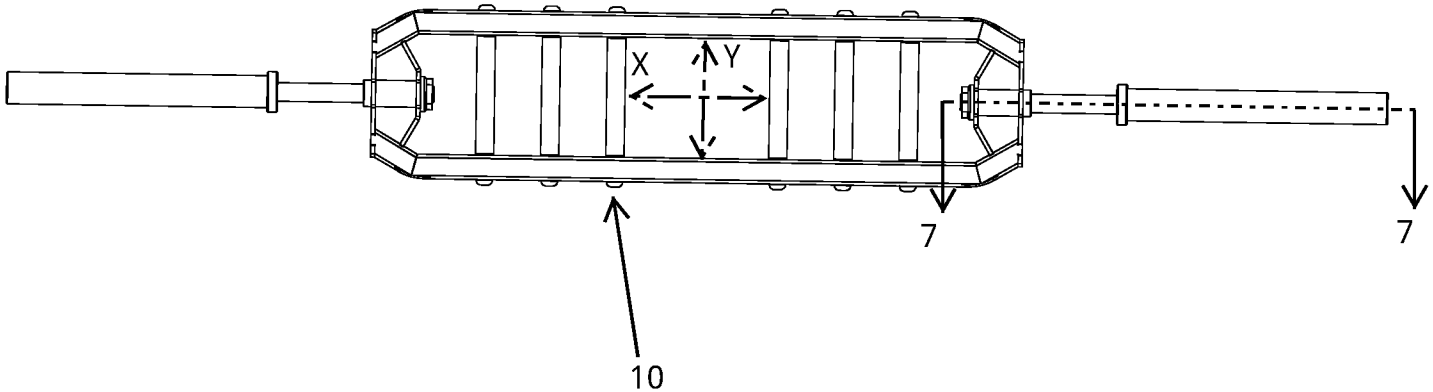
FIG. 6 is a top view of the barbell of FIG. 4.
Figure 7:
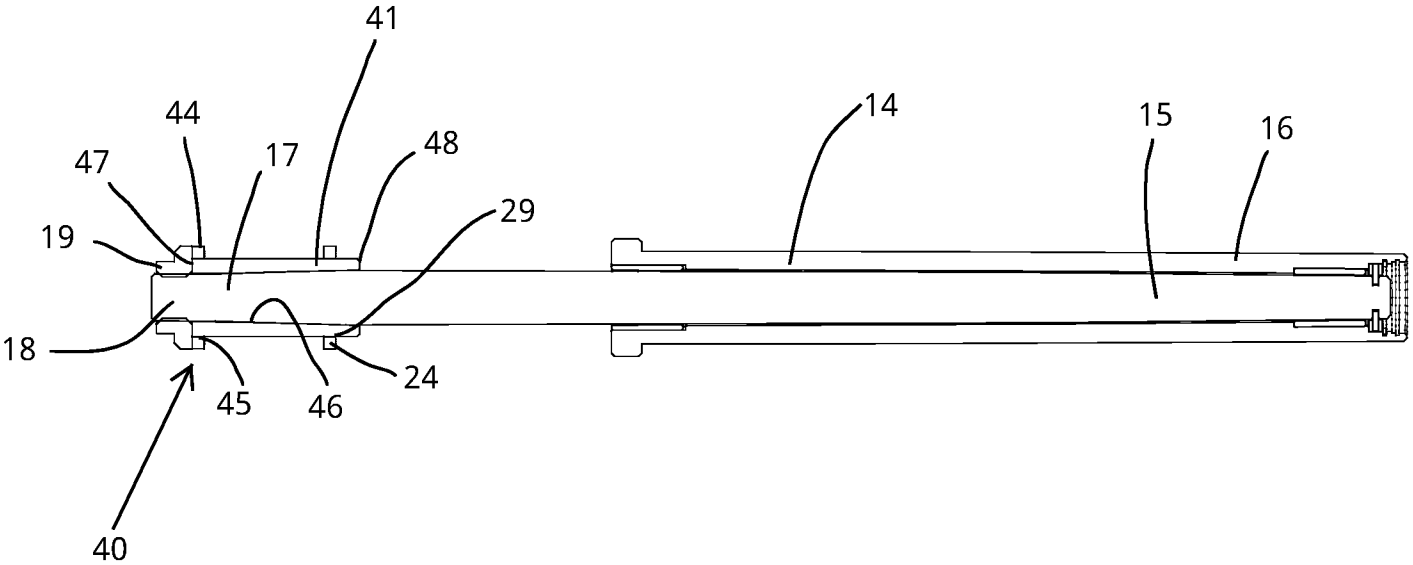
FIG. 7 is a cross-section view taken along lines 7-7 of FIG. 6.
Figure 8:
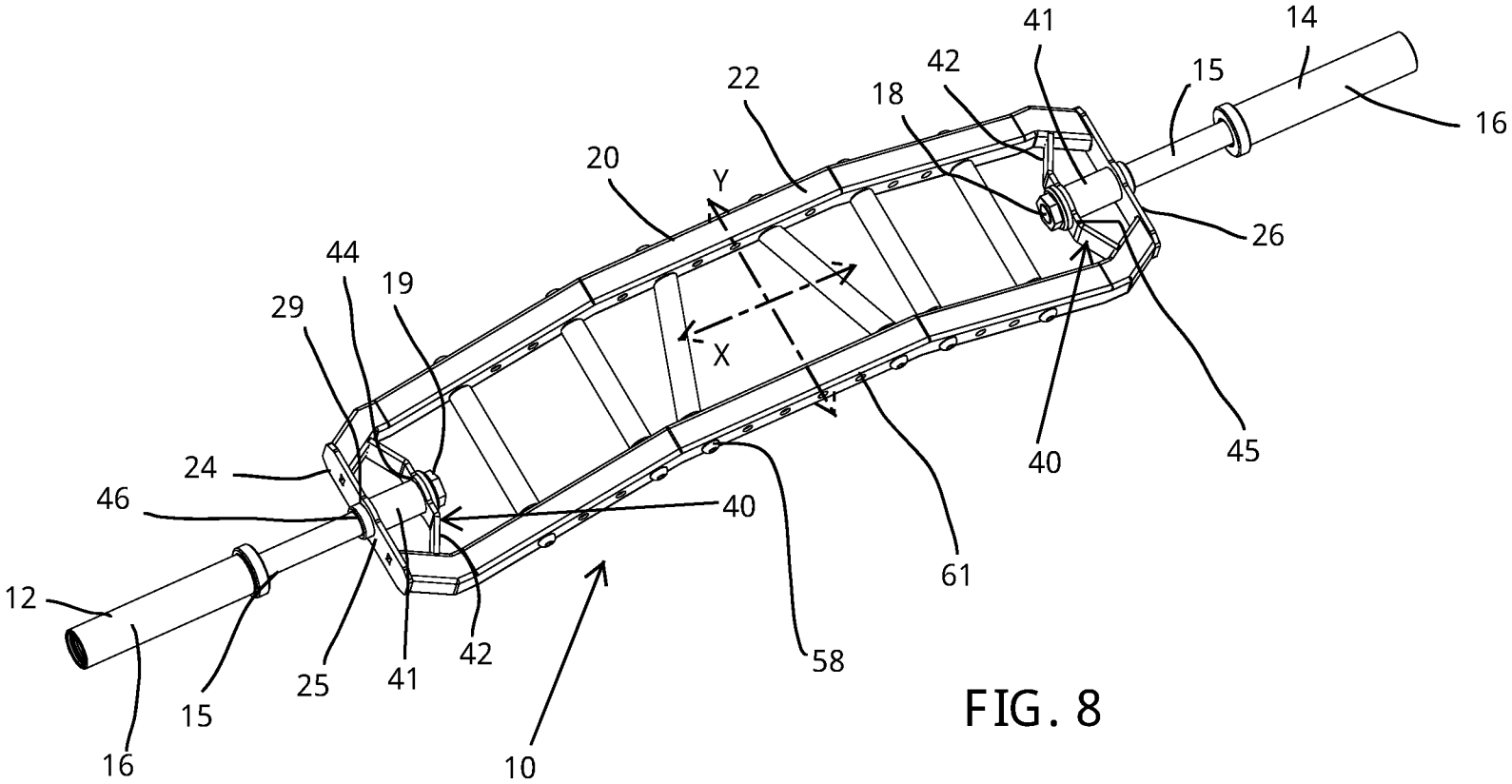
FIG. 8 is a perspective view of another embodiment of a barbell according to aspects of the present disclosure.
Figure 9:
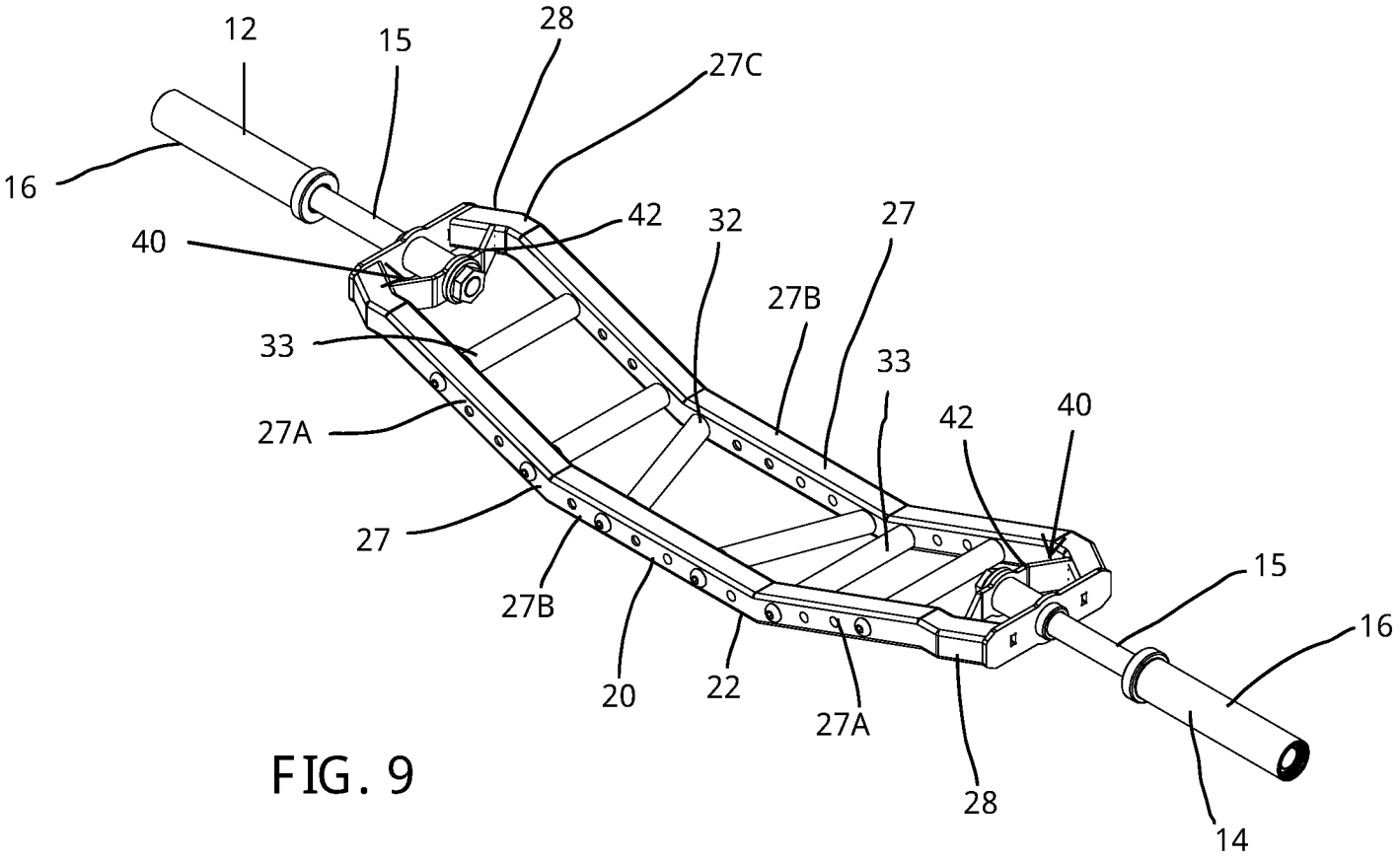
FIG. 9 is a bottom perspective view of the barbell of FIG. 8.
Figure 10:
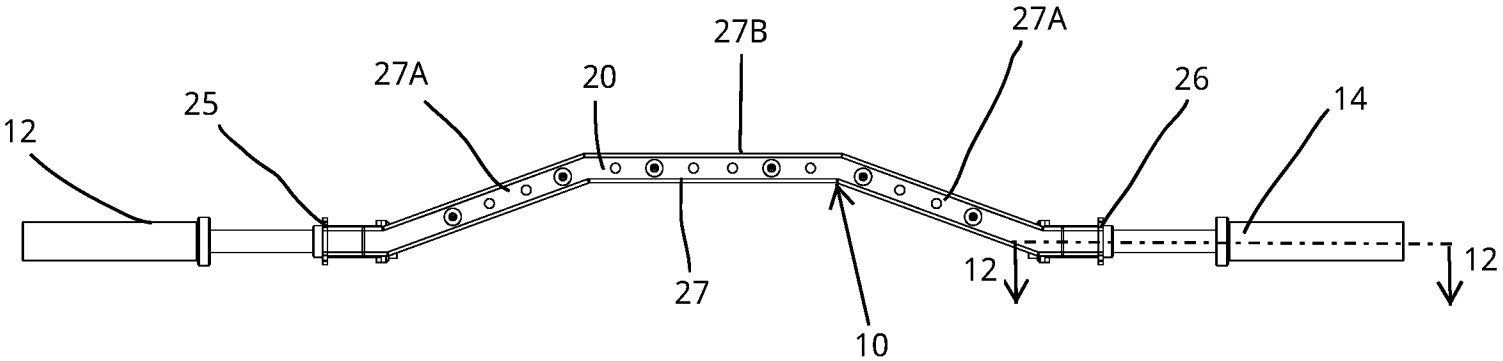
FIG. 10 is a front view of the barbell of FIG. 8.
Figure 11:
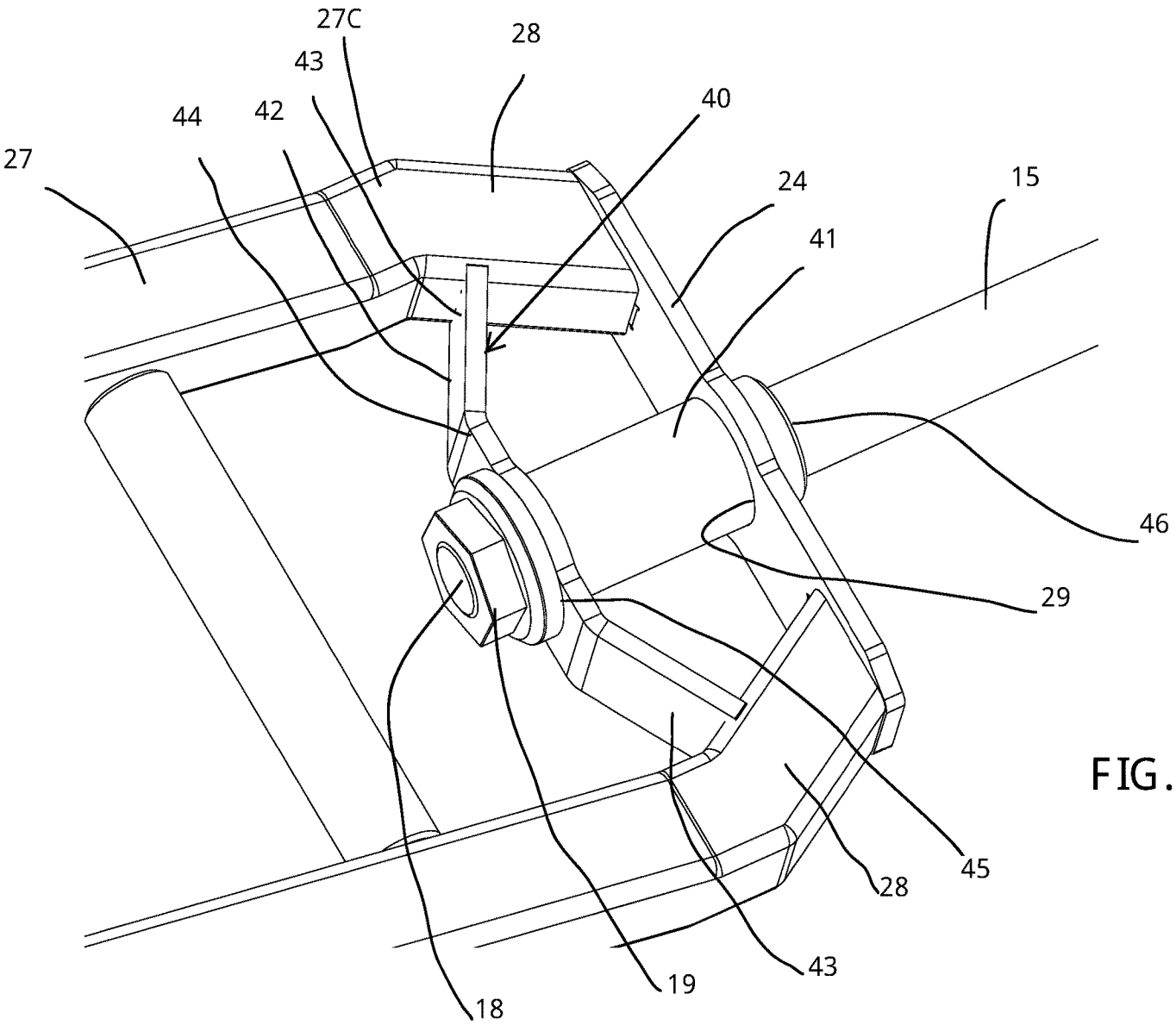
FIG. 11 is a magnified perspective view of a portion of the barbell of FIG. 8.
Figure 12:
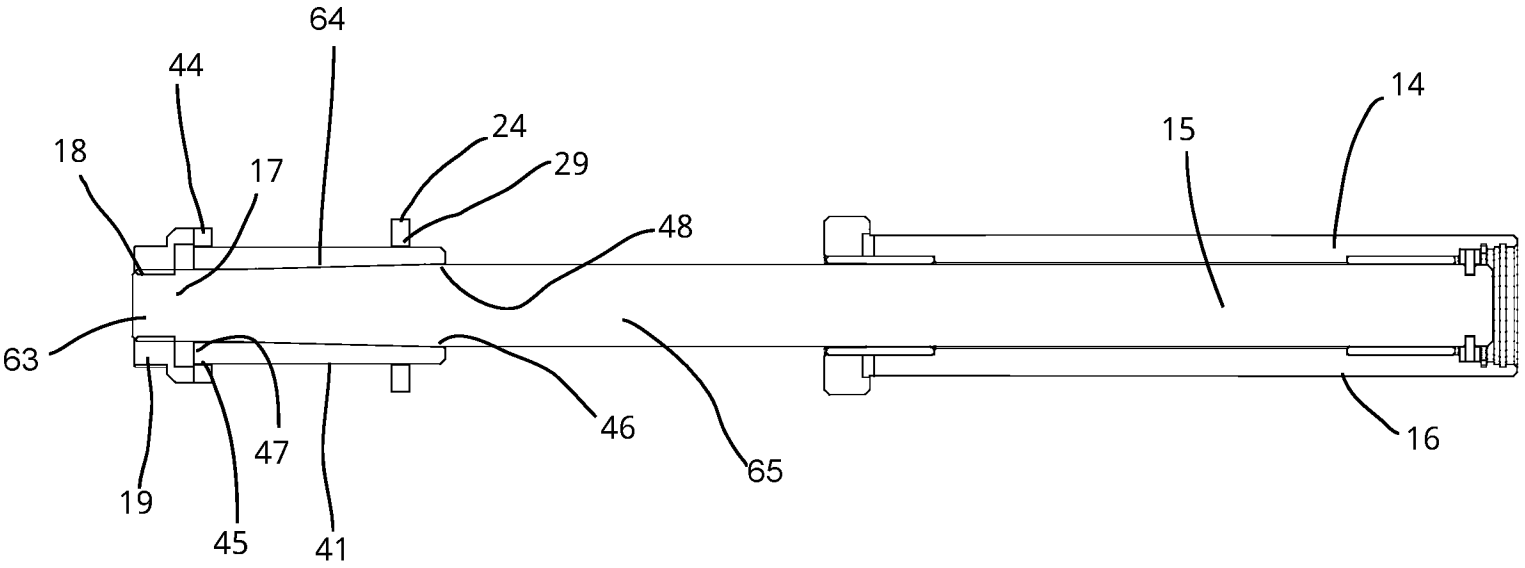
FIG. 12 is a cross-section view of the barbell of FIG. 8 taken along lines 12-12 of FIG. 10.
Figure 13:
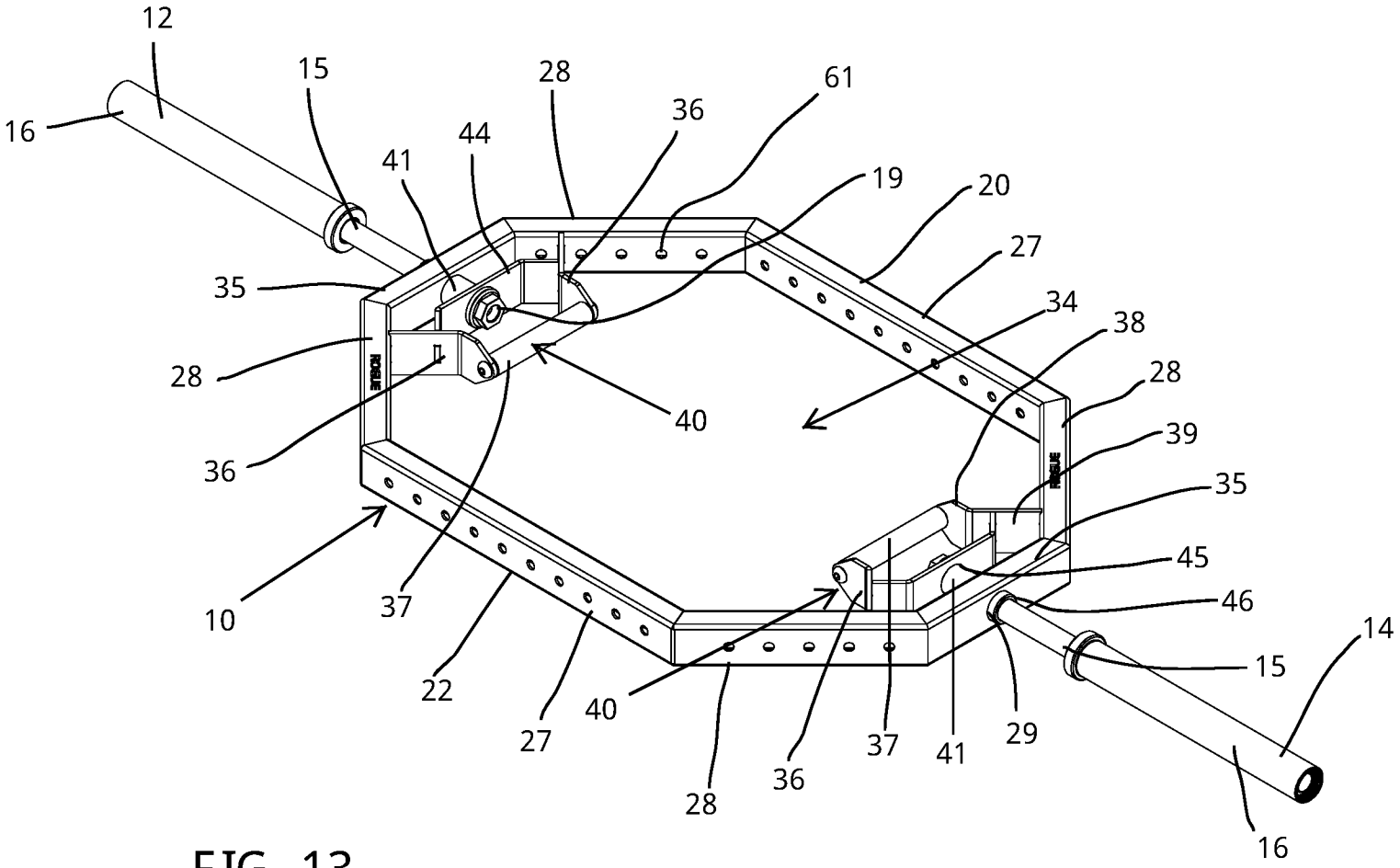
FIG. 13 is a perspective view of another embodiment of a barbell according to aspects of the present disclosure.
Figure 14:
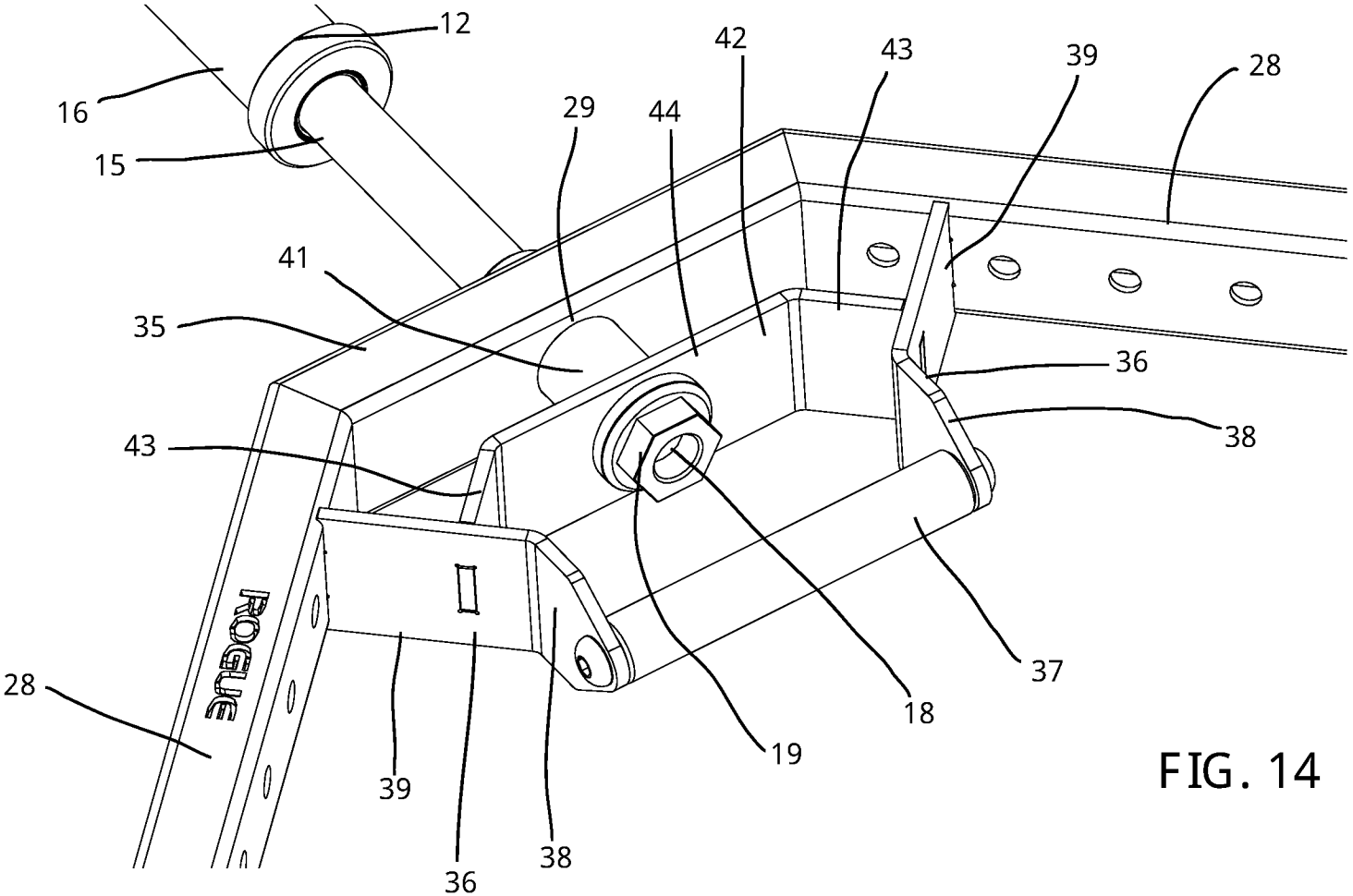
FIG. 14 is a magnified perspective view of a portion of the barbell of FIG. 13.
Figure 15:
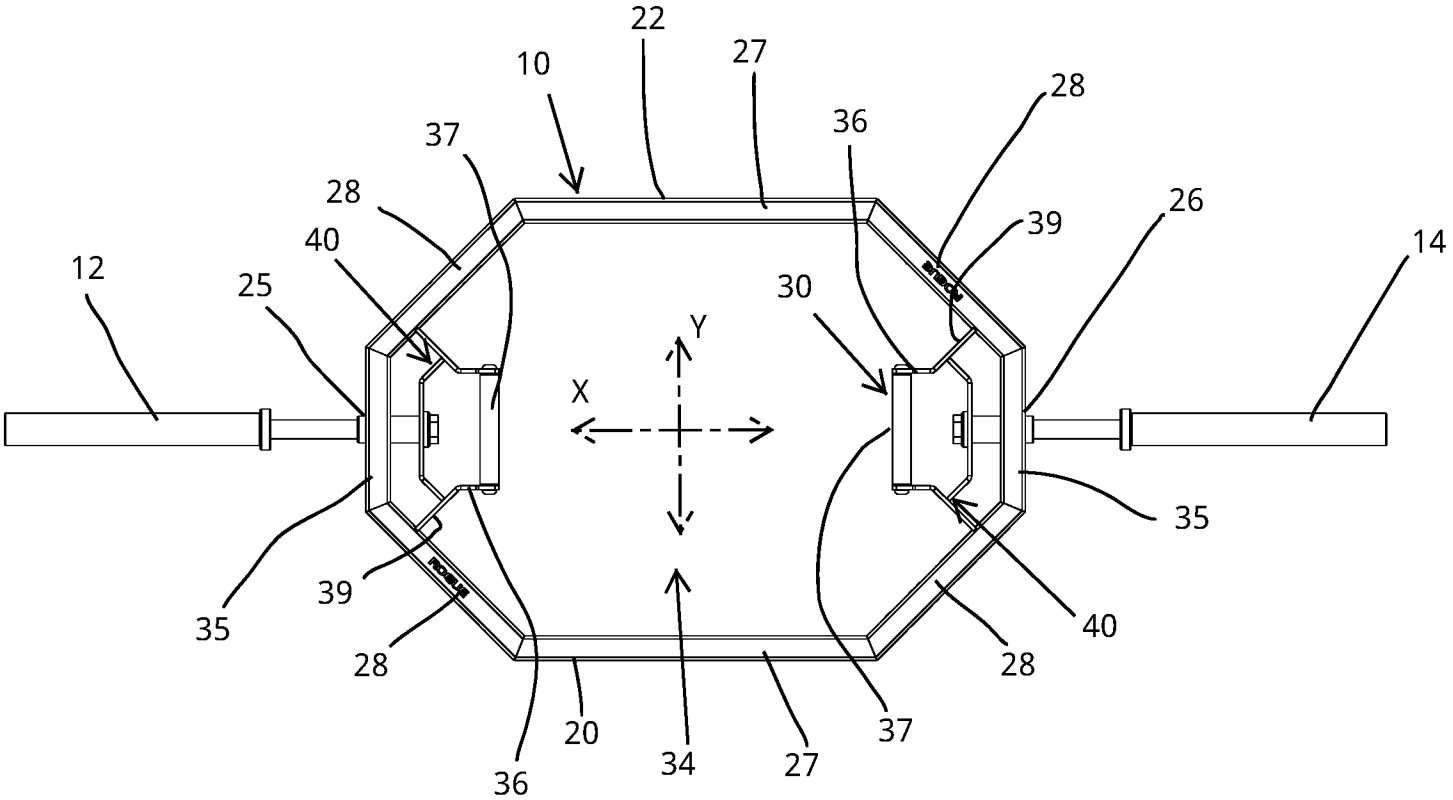
FIG. 15 is a top view of the barbell of FIG. 13.
Figure 16:
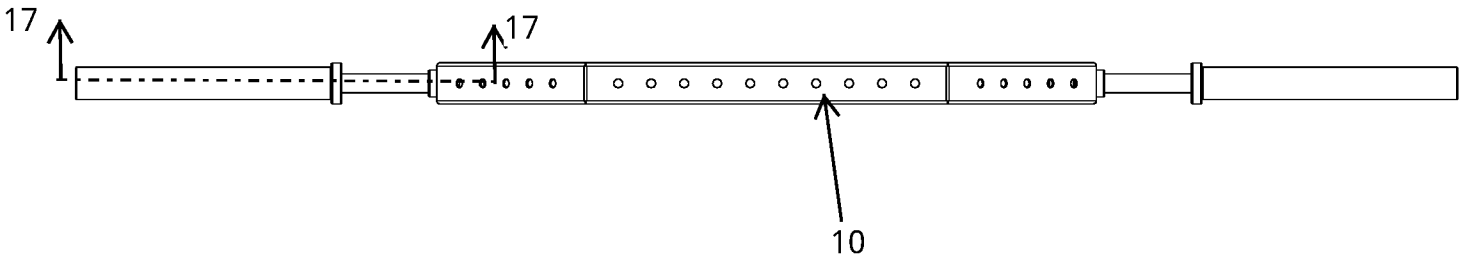
FIG. 16 is a front view of the barbell of FIG. 13.
Figure 17:
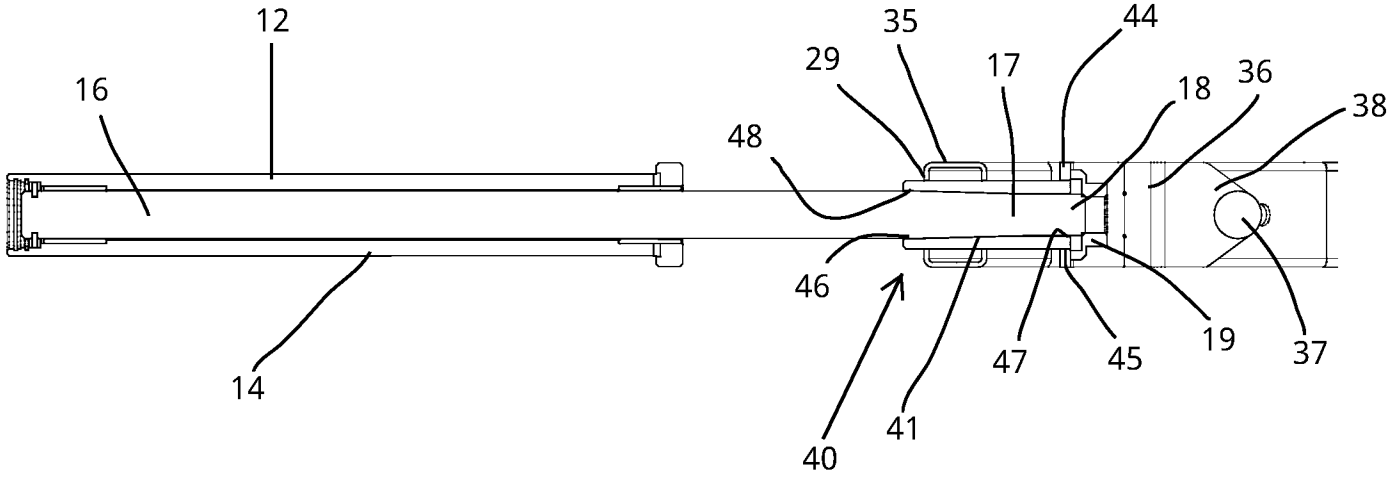
FIG. 17 is a cross-section view of the barbell of FIG. 13, taken along lines 17-17 of FIG. 16.
Figure 18:
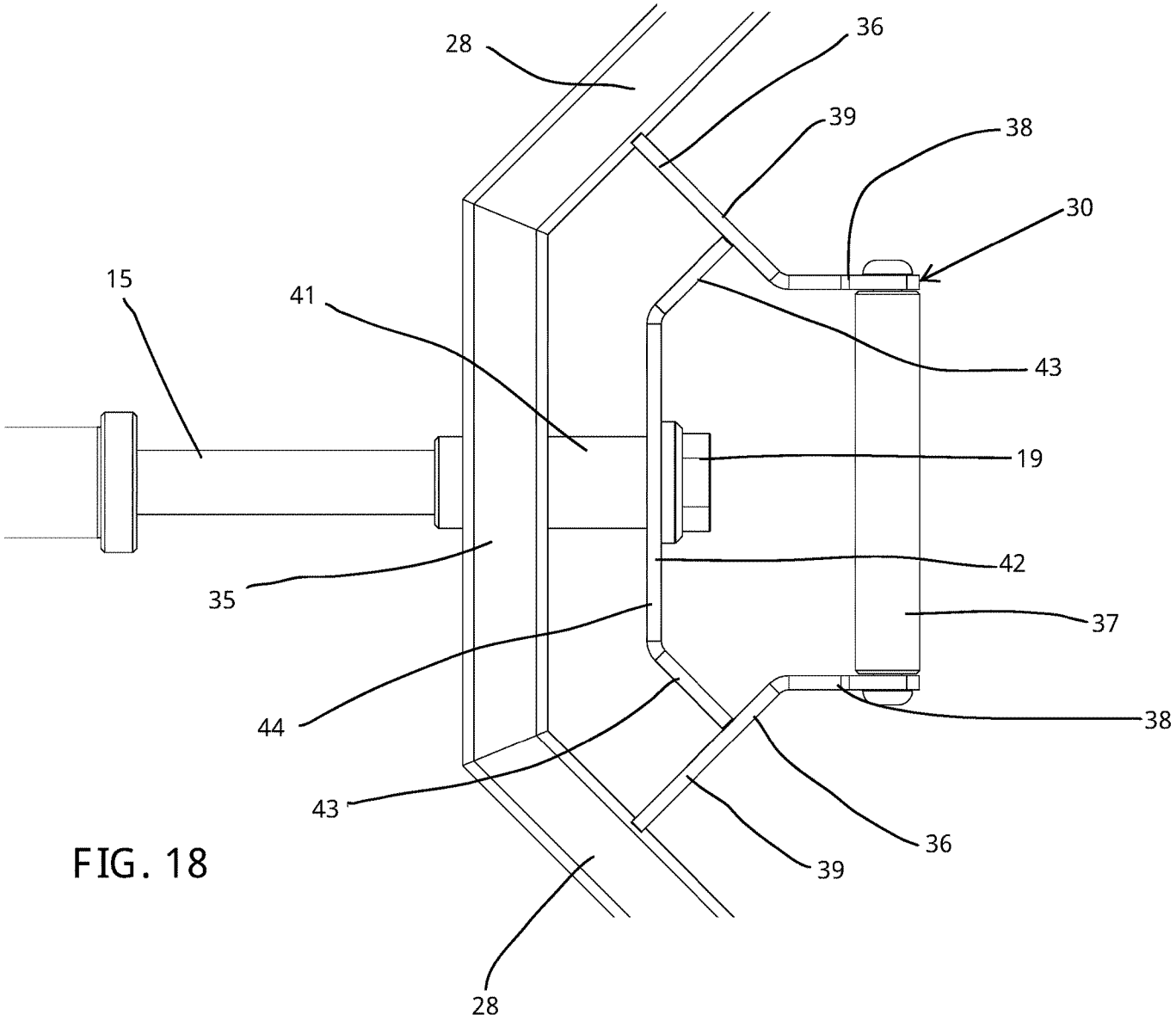
FIG. 18 is a magnified top view of a portion of the barbell of FIG. 13.
Figure 19:
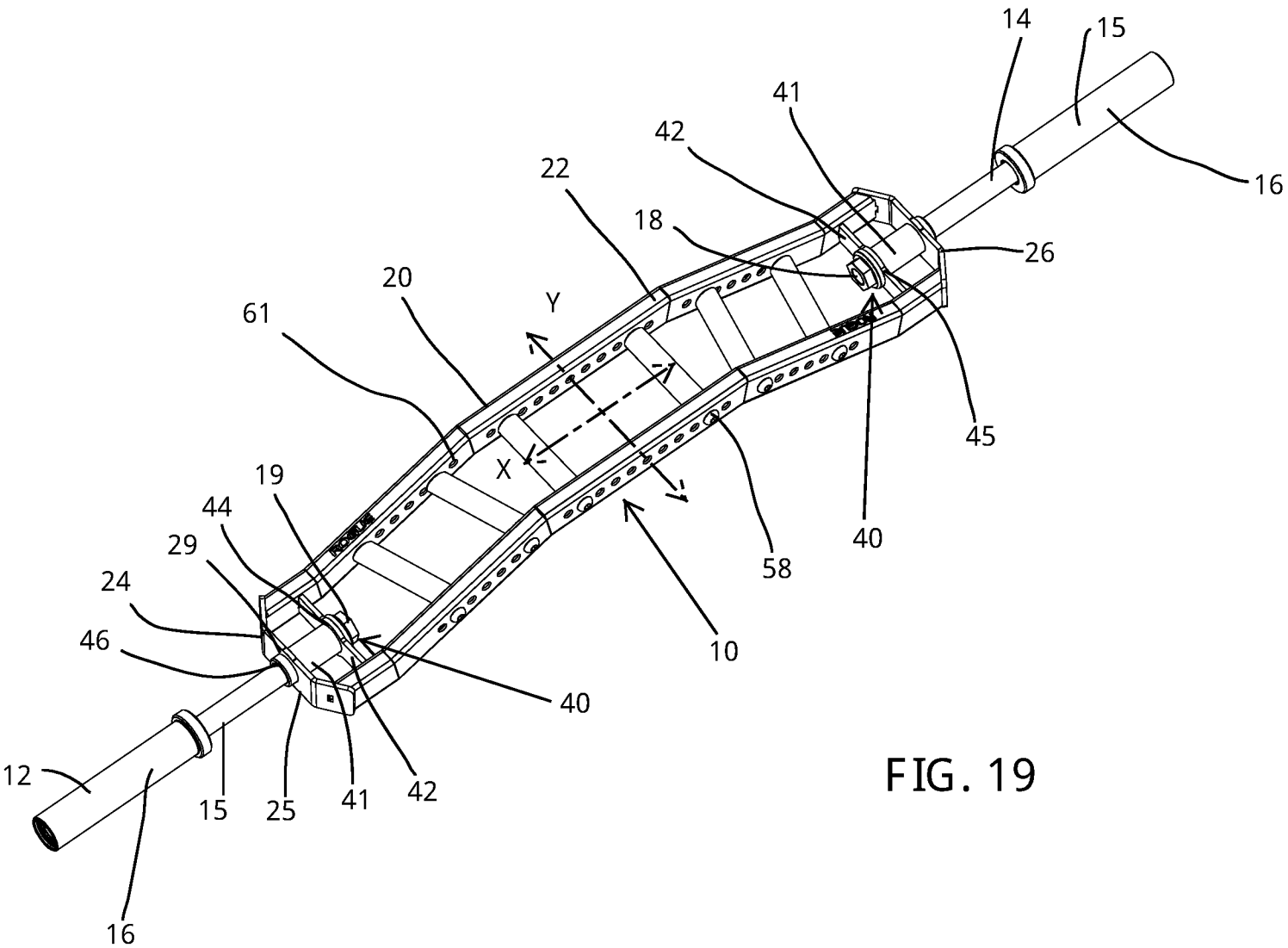
FIG. 19 is a perspective view of another embodiment of a barbell according to aspects of the present disclosure.
Figure 20:
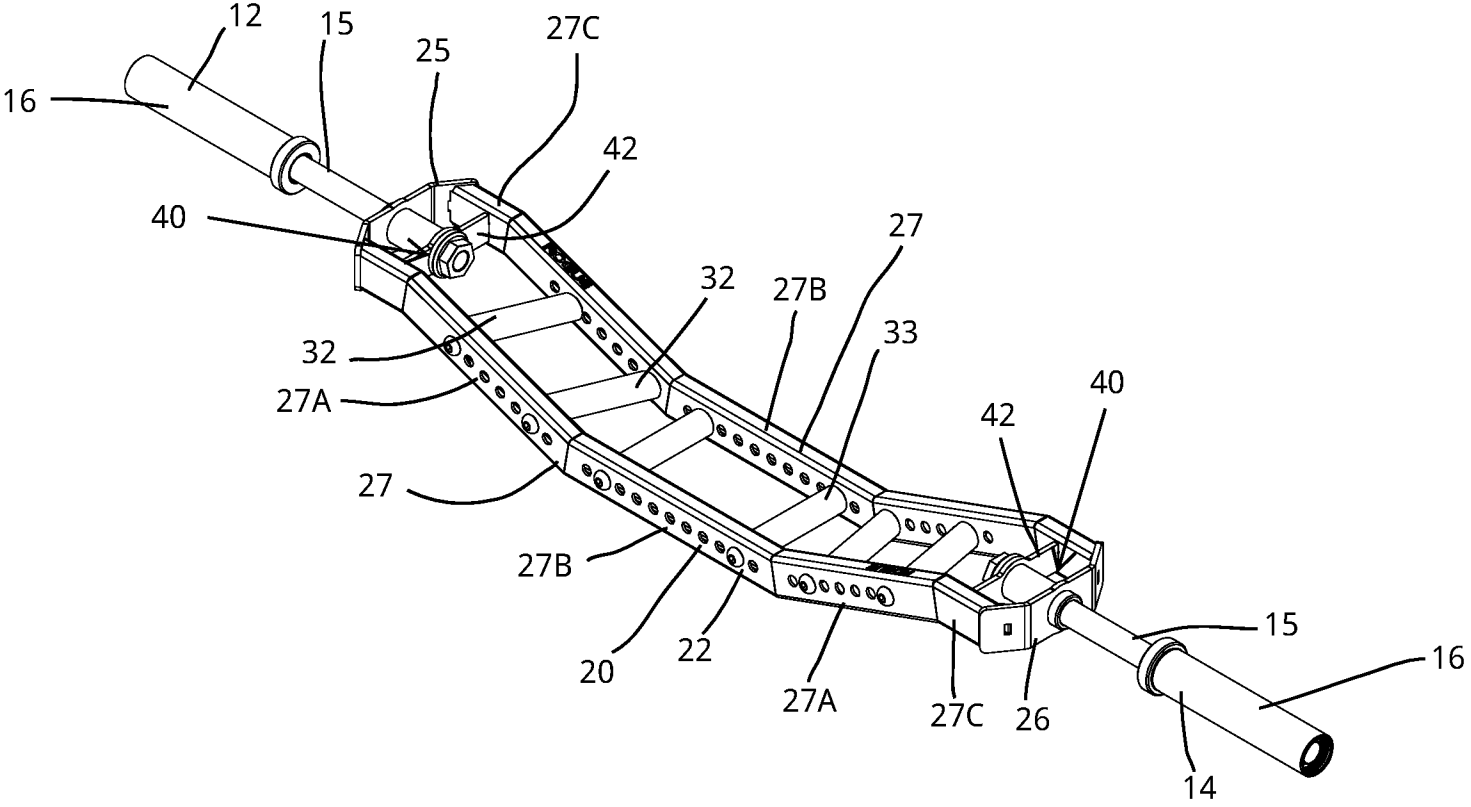
FIG. 20 is a bottom perspective view of the barbell of FIG. 19.
Figure 21:
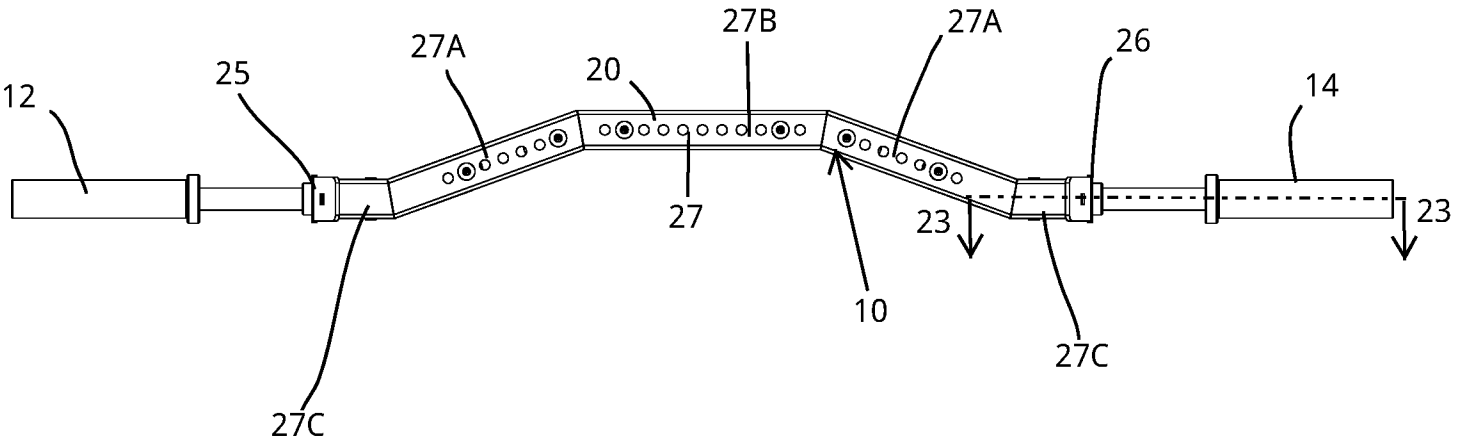
FIG. 21 is a front view of the barbell of FIG. 19.
Figure 22:
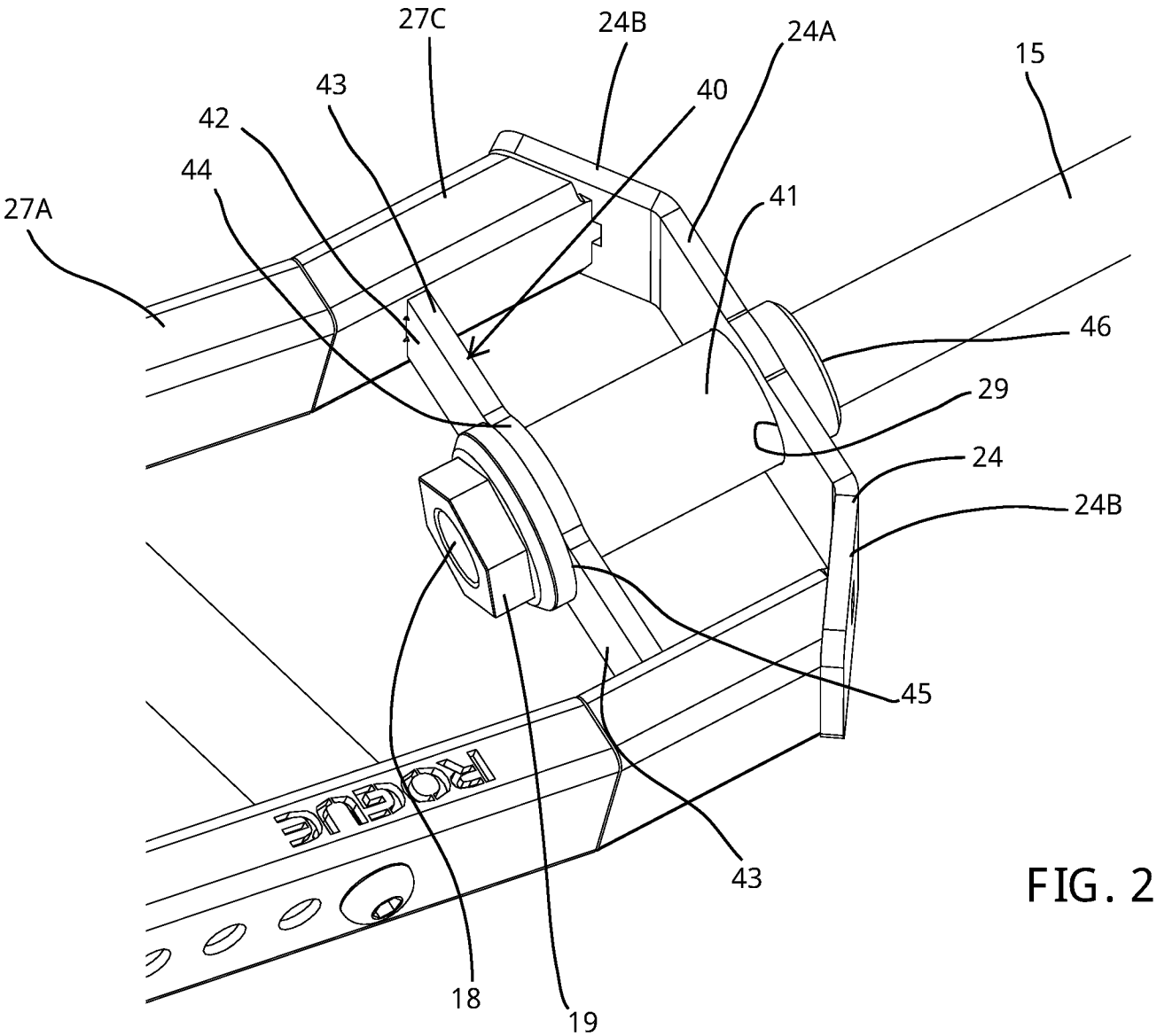
FIG. 22 is a magnified perspective view of a portion of the barbell of FIG. 19.
Figure 23:
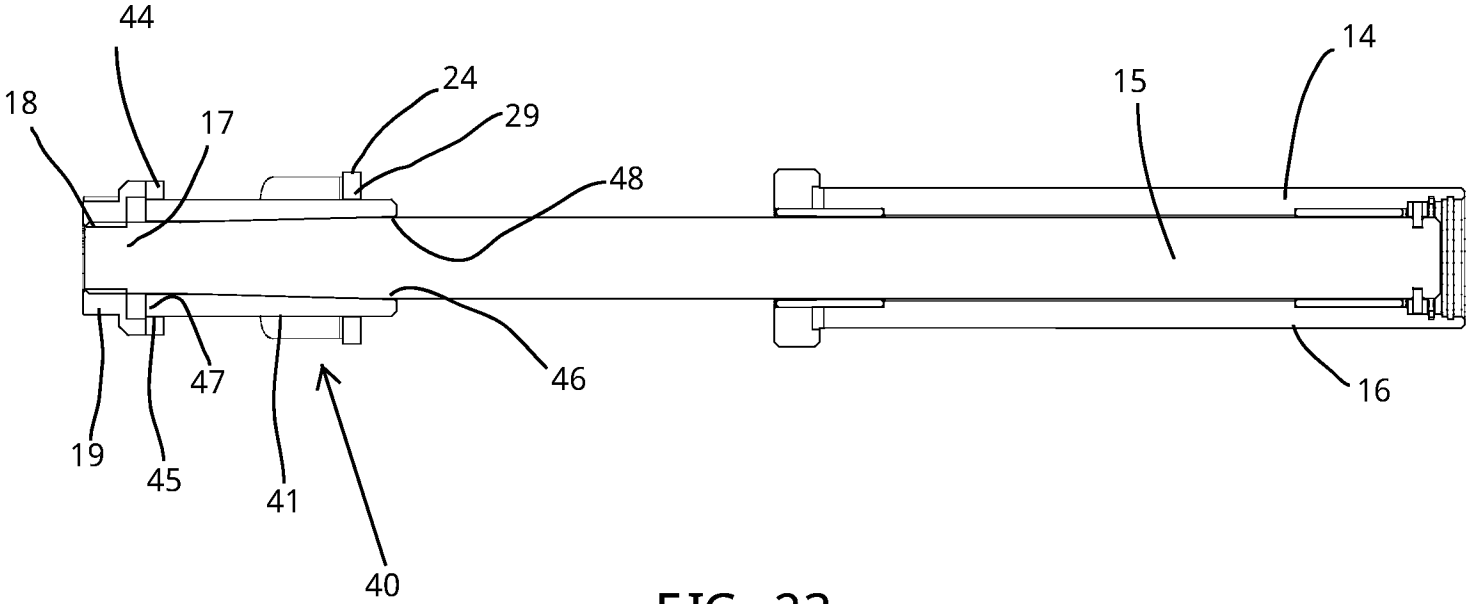
FIG. 23 is a cross-section view of the barbell of FIG. 24 taken along lines 23-23 of FIG. 21.

FIGS. 1-3 illustrate one embodiment of a barbell 10 according to aspects of the disclosure, which includes a central or grip section 20, two barbell sections 12, 14, and a mounting structure 40 connecting the barbell sections 12, 14 to the central section 20. The barbell 10 in FIGS. 1-3 is configured for use as a multi-grip barbell, and the central section 20 in this embodiment is configured for this purpose. In other embodiments, the central section 20 may have a different type of configuration for a different use, including a different specialty use, such as a trap bar, a curved curling bar, a safety squat bar, a log bar, a camber bar, a mutt bar, or any of various other specialty barbell types. The central section 20 in the embodiment of FIGS. 1-3 has a frame 22 made from structural frame members (e.g., tubular steel or other metal beams) with end pieces 24 located at opposite ends 25, 26 of the central section 20. The frame 22 may have a first side portion 54 and a second side portion 55, each formed from one or more frame members, extending between the ends 25, 26. The frame 22 includes two parallel longitudinal members 27 with angled members 28 extending laterally and longitudinally inward from the longitudinal members 27, such that each of the first and second side portions 54, 55 includes one longitudinal member and two angled members 28 at opposite ends thereof. The end pieces 24 in this embodiment are in the form of end plates 24 extending between opposed angled members 28 and connected to the opposed angled members 28. The frame members of the frame 22 may be connected by welding or other integral joining technique in one embodiment, but fasteners or other connection techniques may be additionally or alternately used. The end plates 24 each have an opening 29 therethrough. In the embodiment of FIGS. 1-3, the openings 29 are circular and defined completely within the end plates 24, but may have a different shape and/or a slot-like configuration in another embodiment.

The central section 20 also includes one or more grip members 30 for gripping by a user, and it is understood that the configuration of the grip members 30 may be reflective of the intended use of the barbell 10. The grip members 30 may be rounded or otherwise contoured for gripping, and/or may include knurling or other grip-enhancing structures.

The embodiment of FIGS. 1-3 has grip members 30 that include opposed end portions 31 with a plurality of elongated grips 32 extending between the end portions 31. In this embodiment, the grip members 30 are connected to both side portions 54, 55 of the frame 22 and extend between the side portions 54, 55. The end portions 31 are connected to the inner surfaces of the longitudinal members 27, such as via fasteners 58 or other joining technique. It is understood that the grip members 30 in this embodiment are removable and reconnectable to the frame 22 as desired. The barbell 10 has a longitudinal axis (X) defined by the axes of the barbell sections 12, 14 and a lateral axis (Y) perpendicular to the longitudinal axis (X). A "longitudinal direction" and a "lateral direction" as referred to herein are defined as being parallel to the longitudinal axis (X) and the lateral axis (Y), respectively.

FIGS. 4-7 illustrate another embodiment of a barbell 10, in which the central section 20 has grip members 30 that are configured differently from the barbell 10 of FIGS. 1-3. In FIGS. 4-7, the grip members 30 are in the form of a plurality of elongated grips 33 that are directly connected to the inner surfaces of the longitudinal members 27, such as via fasteners or other joining technique. The grips 33 in this configuration are connected to both side portions 54, 55 of the frame 22 and extend between the side portions 54, 55. In the embodiment of FIGS. 4-7, the grips 33 extend perpendicular to the longitudinal members 27, and in the embodiment of FIGS. 1-3, the grips 32 extend at a non-perpendicular transverse angle to the longitudinal members 27. For example, the grips 32 may extend at a 16° angle or a 20° angle to the lateral axis (Y), i.e., at a 74° angle or a 70° angle, respectively, to the longitudinal members 27 or the longitudinal axis (X). It is understood that the grip members 30 in this embodiment are removable and reconnectable to the frame 22 as desired, including in different arrangements. The barbells 10 in the embodiments of FIGS. 1-3 and 4-7 are substantially identical in all other aspects, and these embodiments will therefore be discussed together for the remainder of this disclosure.

FIGS. 8-12 illustrate another embodiment of a barbell 10, in which the frame 22 and the grip members 30 of the central section 20 are configured differently from the barbells 10 of FIGS. 1-3 and 4-7. In FIGS. 8-12, the longitudinal members 27 of the frame 22 have an arched or cambered configuration that arches upward from both ends 25, 26 toward the longitudinal middle of the frame 22. The longitudinal members 27 in FIGS. 8-12 have inclined sections 27A that extend upward from the ends 25, 26 to a raised section 27B in the middle of the longitudinal length of the frame 22. The inclined sections 27A in this embodiment are linearly angled with respect to the raised section 27B and with respect to the central longitudinal axis (X) of the barbell 10, as defined by the axes of the barbell sections 12, 14. In another embodiment, the inclined sections 27A may be curved along at least a portion of their lengths and/or may have a stepped or other angular configuration. Each raised section 27B in this embodiment is a straight linear section that extends longitudinally parallel to the central longitudinal axis (X) of the barbell 10, as defined by the axes of the barbell sections 12, 14. The inclined sections 27A form obtuse angles with respect to the raised section 27B and the central longitudinal axis (X) of the barbell 10. The frame 22 in FIGS. 8-12 has angled members 28 extending inward from the longitudinal members 27, and end pieces 24 in the form of end plates that extend between the angled members 28 and are connected to the angled members 28. The longitudinal members 27 in FIGS. 8-12 are parallel to each other over their entire lengths, and each longitudinal member 27 generally exists in a vertical plane between the angled members 28. Each side portion 54, 55 of the frame 22 in this embodiment includes one longitudinal member and two angled members 28 at opposite ends thereof. Additionally, each longitudinal member 27 in FIGS. 8-12 has end sections 27C extending longitudinally parallel to the central longitudinal axis (X) of the barbell 10 and extending a short distance between the distal ends of the inclined sections 27A and the angled members 28. In other embodiments, the longitudinal members 27 may have some lateral extent.

The grip members 30 in FIGS. 8-12 are in the form of a plurality of elongated grips 33 that are directly connected to the inner surfaces of the longitudinal members 27, such as via fasteners or other joining technique. The barbell 10 of FIGS. 8-12, has grips 33 that extend perpendicular to the longitudinal members 27, as well as grips 32 that extend at a non-perpendicular transverse angle to the longitudinal members 27. The grips 33 in this configuration are connected to both side portions 54, 55 of the frame 22 and extend between the side portions 54, 55. The barbell 10 in the embodiment of FIGS. 8-12 is substantially identical to the barbells 10 in the embodiments of FIGS. 1-3 and 4-7 in all other aspects, and these embodiments will therefore be discussed together for the remainder of this disclosure.

The mounting structure 40 in the barbells 10 of FIGS. 1-12 includes tubular members 41 located at each end 25, 26 of the central section 20 and configured for connection of the barbell sections 12, 14. The tubular members 41 in one embodiment may be DOM (drawn over mandrel) type tubing made from steel. The tubular members 41 are connected to the end plates 24, and in the embodiments of FIGS. 1-12, the tubular members 41 are received within the openings 29 in the end plates 24 and extend through the end plates 24. A portion of the outer end 48 of each tubular member 41 protrudes outward from each end plate 24 in FIGS. 1-12. The mounting structure 40 also includes brace members 42 each connected to the frame 22 and one of the tubular members 41 to further secure the connection of the tubular members 41. Each brace member 42 in FIGS. 1-12 has two angled legs 43 that are connected to the frame 22, e.g., by welding to the angled members 28 thereof, with a mounting plate 44 connected to the legs 43. The brace members 42 in FIGS. 1-12 are each connected to the tubular members 41 at a location spaced inwardly from the corresponding end piece 24, such that the respective mounting plate 44 is spaced inwardly from the corresponding end piece 24. The angled legs 43 extend inward toward the lateral centerline of the barbell 10 and inward toward the longitudinal centerline of the barbell 10, such that the angled legs 43 are angled with respect to the longitudinal members 27, the angled members 28, and the axes of the tubular members 41. Each mounting plate 44 has an opening 45 that receives a portion of the tubular member 41 therethrough, which may be configured similarly to the openings 29 in the end plates 24. The inner ends 47 of the tubular members 41 may be substantially flush with the inner surfaces of the mounting plates 44 in one embodiment. The tubular members 41 may be connected to the end plates 24 and the mounting plates 44 by welding or other integral joining technique in one embodiment, and it is understood that other connection techniques and/or mechanical mating techniques may additionally or alternately be used.

Each tubular member 41 has a central passage 46 that receives a portion of the barbell sections 12, 14 for connection of the barbell sections 12, 14 to the central section 20. The central passage 46 of each tubular member 41 in FIGS. 1-12 extends completely through the tubular member 41, from the inner end 47 to the outer end 48 thereof, although in another embodiment, the central passage 46 may be a blind hole from the inner end 47. In the embodiment of FIGS. 1-12, the central passage 46 of each tubular member is tapered, such that the inner diameter of the passage 46 decreases from the outer end 48 to the inner end 47. In one embodiment, a Morse taper may be used, and the inner diameter of the passage 46 may be approximately 1 3/16 inch at the outer end 48 and approximately 1 inch at the inner end 47. The degree of taper may be up to 8° in one embodiment, and in another embodiment, may be from 1° to 5°.

Each barbell section 12, 14 has a bar portion 15 with a sleeve 16 fixedly or rotatably mounted on the bar portion 15. In an embodiment, where the sleeve 16 is rotatably mounted on the bar portion 15, bushings, bearings, and other rotation-enabling structures 59 may be used between the sleeve 16 and the bar portion 15 to permit free rotation of the sleeve 16. Such components may not be necessary in an embodiment where the sleeve 16 is fixedly mounted on the bar portion 15. Any known connection or configuration of the bar portions 15 and the sleeves 16 may be used in various embodiments. The sleeves 16 are configured for holding one or more weight plates, as known in the art. Each bar portion 15 has a proximal end 17 that extends through the central passage 46 the tubular member 41 and extends out of the central passage 46 at the inner end 47 for connection to the central section 20. The proximal end 17 in the embodiment of FIGS. 1-12 has a connection portion 18 configured for connection to a fastener 19 to connect the bar portion 15 to the central section 20. The fastener 19 is positioned at the inner end 47 of the respective tubular member 41 and is tightly engaged with the inner end 47 in this embodiment. The connection portion 18 is a threaded member in the embodiment of FIGS. 1-12, and the fastener 19 is a knob or nut that is threadably engaged with the connection portion 18. In another embodiment, the proximal end 17 may not extend completely through the tubular member 41. In one embodiment, the proximal end 17 of each bar portion 15 is tapered to be narrower toward the proximal end 17, and the degree of taper of the proximal end 17 may match the degree of the taper of the passage 46 of the tubular member 41, e.g., by being complementary and/or substantially identical thereto. In other words, the outer diameter of the proximal end 17 of each bar portion 15 may be complementary and/or substantially identical to the inner diameter of the passage 46 along a relevant portion of the length of the proximal end 17. As shown more clearly in FIG. 39, the proximal end 17 of each bar portion 15 in the embodiment of FIGS. 1-12 has an end portion 63 that is not tapered and has a substantially constant width, a tapered portion 64 that extends along a portion of the length of the bar portion 15 and is tapered as described herein, and a sleeve portion 65 that is configured for connection to the sleeve 16 and may also have a substantially constant width. The tapering may be configured differently in other embodiments, and it is understood that a constant-width end portion 63 may not be necessary if a different type of connection is used for connection to the central section 20, other than a threaded fastener 19.

In the configuration of FIGS. 1-12, the complementary tapering of the bar member 15 and the passage 46 creates a natural stop for insertion of the bar member 15 into the tubular member 41. Further, the tightening of the fastener 19 causes tighter engagement between the bar member 15 and the tubular member 41, thereby increasing the strength and stability of the connection. This configuration therefore simplifies assembly of the barbell 10. In one embodiment, the barbell 10 may be provided as part of a kit, with the central section 20 assembled and the two barbell sections 12, 14 disconnected from the central section 20, and the purchaser can assemble the barbell 10 themselves, by insertion of the bar members 15 into the tubular members 41 and then connecting the fasteners 19. It is understood that the sleeves 16 may also be included separate from the bar members 15 for further assembly in one embodiment. It is also understood that some or all of the grip members 30 may be included separate from the central section 20 for connection in desired locations and orientations. This configuration also provides a specialty barbell having barbell sections 12, 14 with rotating sleeves 16, with superior ease of manufacturability and cost efficiency.

Figure 39:
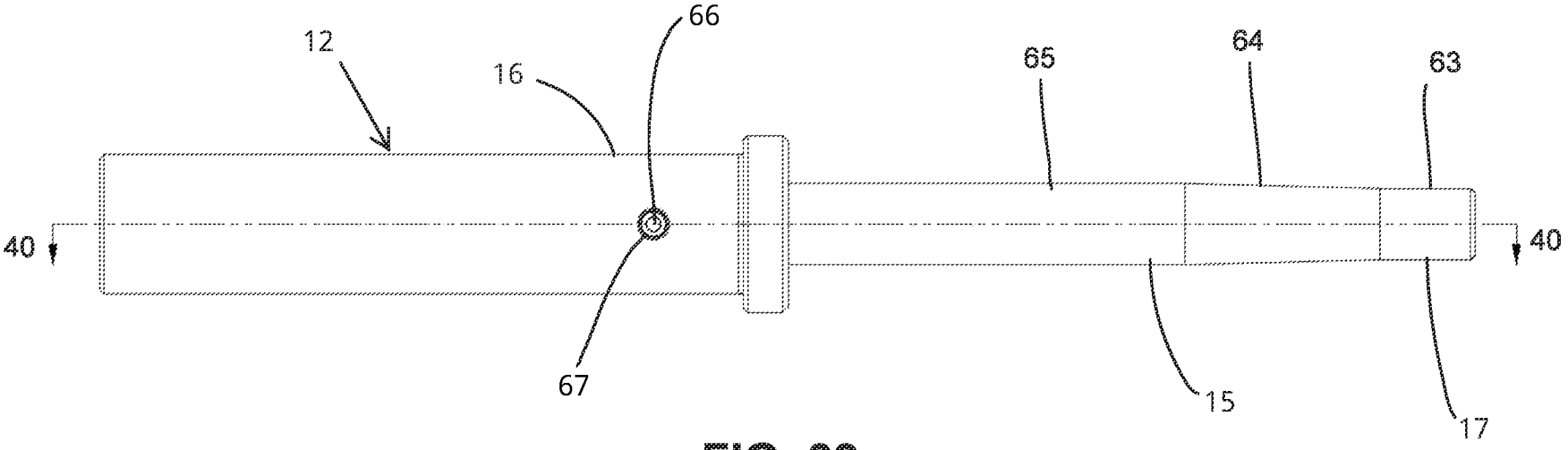
FIG. 39 is a top view of another embodiment of a barbell section suitable for use in a barbell according to aspects of the present disclosure.
Figure 40:
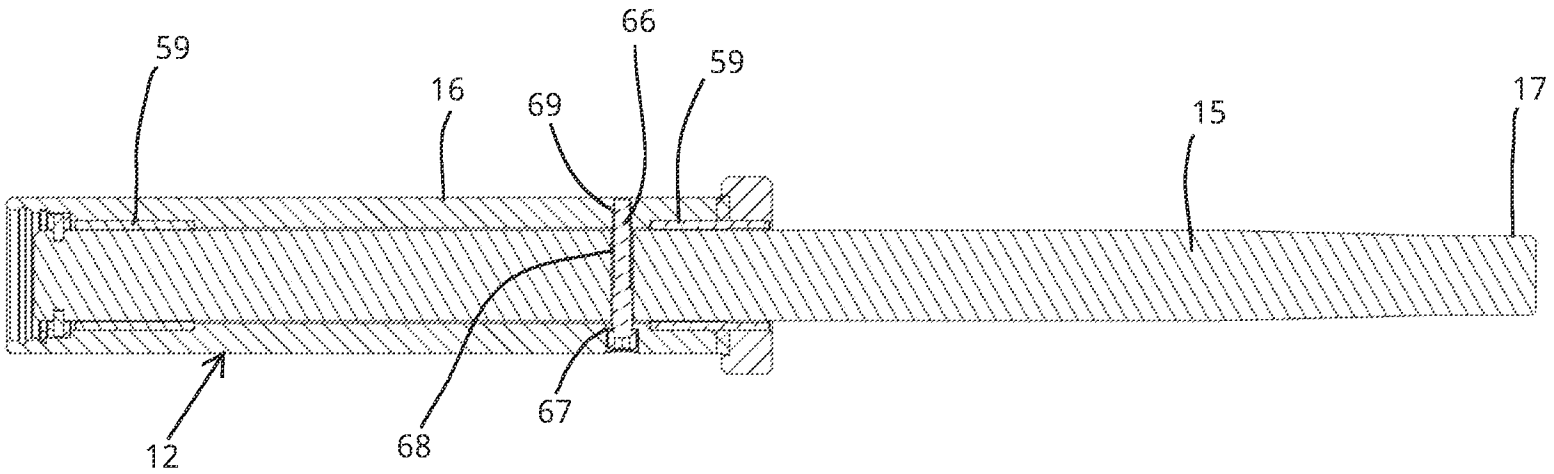
FIG. 40 is a cross-section view of the barbell section of FIG. 39 taken along lines 40-40 of FIG. 39.

FIGS. 39-40 illustrate another embodiment of a barbell section 12 that may be used with the embodiments of a central section 20 described herein. In the embodiment of FIGS. 39-40, the sleeve 16 is configured to be selectively rotatable or fixed with respect to the bar portion 15. The barbell section 12 is generally structured in the same manner as the barbell sections 12, 14 of FIGS. 1-12, having bushings, bearings, and/or other rotation-enabling structures 59 to enable free rotation of the sleeve 16 around the bar portion 15. The barbell section 12 also includes a fixing member 66 configured to releasably lock or fix the sleeve 16 with respect to the bar portion 15. The fixing member 66 in FIGS. 39-40 is in the form of a threaded bolt that is inserted into the sleeve 16 and the bar portion 15. In the embodiment of FIGS. 39-40, the bolt 66 extends through an entrance hole 67 in the sleeve 16, through a passage 68 extending completely through the bar portion 15, and into a threaded hole 69 in the sleeve 16 opposite the entrance hole 67. The entrance hole 67 is countersunk to accommodate the head of the bolt 66 and permit the bolt 66 to be sunk completely inward of the outer diameter of the sleeve portion 16. In other embodiments, the threaded hole 69 may not extend completely through the sleeve 16 or may not be present at all, such as if the passage 68 in the bar portion 15 has a portion of its length threaded to connect with the bolt 66. This structure permits the user to insert the bolt 66 when a fixed sleeve 16 is desired, or to remove the bolt 66 when a rotatable sleeve 16 is desired. Other fixing members 66 may be used in other embodiments, including fixing members 66 using other connection techniques.

FIGS. 13-18 illustrate another embodiment of a barbell 10, in which the central section 20 is configured in a trap bar configuration that defines a space 34 in which a user can be positioned during use of the barbell 10. The embodiment of FIGS. 13-18 includes many components and features in common with the embodiments of FIGS. 1-12 as described herein. Such common components and/or features may not be described again, or may not be described in full detail, with respect to the embodiment of FIGS. 13-18 for the sake of brevity. The frame 22 of the central section 20 in FIGS. 13-18 is made from structural frame members (e.g., tubular steel or other metal beams) and includes longitudinal members 27 located in the longitudinal middle of the central section 20, end pieces in the form of lateral or end members 35 located at opposite ends 25, 26 of the central section 20, and angled members 28 extending inward from the longitudinal members 27. Each side portion 54, 55 in this embodiment includes one longitudinal member 27 and two angled members 28 at opposite ends thereof. The longitudinal members 27 in this embodiment are parallel to each other and parallel to the longitudinal axis (X) of the barbell 10, as defined by the longitudinal axes of the barbell sections 12, 14. The end members 35 in the embodiment of FIGS. 13-18 are in the form of tubular members similar to the longitudinal members 27 and the angled members 28, but may be in the form of end plates such as in the embodiments of FIGS. 1-12 in another embodiment. The end members 35 extend between the opposed angled members 28 and are connected to the opposed angled members 28. The frame 22 in this embodiment exists generally in a horizontal plane, but one or more of the frame members may have a vertical extent in another embodiment. The frame members of the frame 22 may be connected in the same manner as described herein, e.g., welding or other integral joining technique, fasteners or other connection techniques, etc. The end members 35 each have an opening 29 therethrough, and the openings 29 in this embodiment are circular and defined completely within the end plates 35, but may have a different shape and/or a slot-like configuration in another embodiment.

The mounting structure 40 in the barbell 10 of FIGS. 13-18 includes tubular members 41 located at each end 25, 26 of the central section 20 and configured for connection of the barbell sections 12, 14, which are configured as described herein with respect to FIGS. 1-12. The tubular members 41 are connected to the end members 35, such that the tubular members 41 are received within the openings 29 in the end members 35 and extend through the end members 35. The mounting structure 40 in FIGS. 13-18 also includes brace members 42 each connected to the frame 22 and one of the tubular members 41 to further secure the connection of the tubular members 41. Each brace member 42 in FIGS. 13-18 has two angled legs 43 that are connected to the frame 22 as described herein, with a mounting plate 44 connected to the legs 43. The brace member 42 in this embodiment is connected to grip mounts 36 as described herein and extend between the grip mounts 36. The angled legs 43 extend outwardly away from the lateral centerline of the barbell 10 and inward toward the longitudinal centerline of the barbell 10, such that the angled legs 43 are angled with respect to the longitudinal members 27, the angled members 28, and the axes of the tubular members 41. The angled legs 43 extending outward from the lateral centerline of the barbell 10 provides space between the mounting plates 44 and the grips 37 to permit a user's hands to engage the grips 37. Each mounting plate 44 has an opening 45 that receives a portion of the tubular member 41 therethrough, as described herein with respect to FIGS. 1-12. The inner ends 47 of the tubular members 41 may be substantially flush with the inner surfaces of the mounting plates 44 in one embodiment. The tubular members 41 may be connected to the end members 35 and the mounting plates 44 by welding or other integral joining technique in one embodiment, and it is understood that other connection techniques and/or mechanical mating techniques may additionally or alternately be used.

Each tubular member 41 in the embodiment of FIGS. 13-18 may be configured in the same manner as the tubular member 41 described herein with respect to FIGS. 1-12. Each barbell section 12, 14 may also be configured in the same manner as the barbell sections 12, 14 described herein with respect to FIGS. 1-12. In this configuration, each bar portion 15 has a proximal end 17 that extends through the tubular member 41 for connection to the central section 20. The proximal end 17 has a connection portion 18 configured for connection to a fastener 19 to connect the bar portion 15 to the central section 20.

The barbell 10 in FIGS. 13-18 has grips 37 that are mounted on grip mounts 36 that are connected to the frame 22 in a manner described herein, e.g., by welding. The grip mounts 36 in this embodiment are connected to the angled members 28 in a manner described herein and have distal end portions 38 connected to the grips 37. In one embodiment, each grip mount 36 has an angled portion 39 that extends longitudinally and laterally inward from one of the angled members 28 at approximately a 90° angle to the respective angled member 28, and the distal end portion 38 extending along the longitudinal axis (X) of the barbell 10, forming an obtuse angle with the angled portion 39. In this embodiment, the connection points of the grip mounts 36 to the frame 22 are spaced further apart than the distal end portions 38 of the grip mounts 36. Each grip 37 is connected at opposed ends to the distal end portions 38 of two grip mounts 36 and extends laterally between the grip mounts 36 at approximately a 90° angle to the distal end portions 38. The grips 37 in FIGS. 13-18 are cylindrical bars and may be connected to the grip mounts 36 in a manner as described herein, e.g., fasteners, similar to the other grips 32, 33 described herein. Each pair of grip mounts 36 also has a brace member 42 connected thereto and extending between the grip mounts 36. In the embodiment of FIGS. 13-18, the angled legs 43 of the brace member 42 extend from the angled portions 39 of the grip members 36 at approximately a 90° angle to the respective angled portion 39. In this configuration, the angled legs 43 of each brace member 42 are each substantially parallel to the most proximate angled member 28 of the frame 22. The barbell 10 in FIGS. 13-18 has two grips 37 mounted proximate the ends 25, 26 of the central section 20. It is understood that the barbells 10 in FIGS. 1-12 may have grips 37 mounted in similar configurations in one embodiment.

FIGS. 19-23 illustrate another embodiment of a barbell 10, in which the frame 22 and the grip members 30 of the central section 20 are configured differently from the barbells 10 of FIGS. 1-18. In FIGS. 19-23, the longitudinal members 27 of the frame 22 have an arched or cambered configuration that arches upward from both ends 25, 26 toward the longitudinal middle of the frame 22, similar to the configuration of the frame 22 in FIGS. 8-12. The longitudinal members 27 in FIGS. 19-23 have inclined sections 27A that extend upward from the ends 25, 26 to a raised section 27B in the middle of the longitudinal length of the frame 22. The inclined sections 27A in this embodiment are linearly angled with respect to the raised section 27B and with respect to the central longitudinal axis (X) of the barbell 10, as defined by the axes of the barbell sections 12, 14. In another embodiment, the inclined sections 27A may be curved along at least a portion of their lengths and/or may have a stepped or other angular configuration. Each raised section 27B in this embodiment is a straight linear section that extends longitudinally parallel to the central longitudinal axis (X) of the barbell 10, as defined by the axes of the barbell sections 12, 14. The inclined sections 27A form obtuse angles with respect to the raised section 27B and the central longitudinal axis (X) of the barbell 10. Each side portion 54, 55 in this embodiment includes one longitudinal member 27, and both side portions 54, 55 extend along the longitudinal axis (X) and not the lateral axis (Y). The frame 22 in FIGS. 19-23 has a width perpendicular to the central longitudinal axis (X) that is narrower than that of the frame 22 of the barbell 10 in FIGS. 8-12. Additionally, the pieces forming the longitudinal members 27 in the embodiment of FIGS. 19-23 are rectangular tubing (e.g., 2"×1"), in contrast to the embodiments of FIGS. 1-12, where the longitudinal members 27 and the angled members 28 are formed of square tubing (e.g., 1.5"×1.5").

The frame 22 in FIGS. 19-23 has end pieces 24 in the form of end plates that extend between the distal ends of the longitudinal members 27 and are connected to the longitudinal members 27. Each longitudinal member 27 in FIGS. 19-23 has end sections 27C extending longitudinally parallel to the central longitudinal axis (X) of the barbell 10 and extending between the distal ends of the inclined sections 27A and the end plates 24. The end plates 24 are connected to the end sections 27C and extend between the end sections 27C in this embodiment. The longitudinal members 27 in FIGS. 19-23 are parallel to each other over their entire lengths, and each longitudinal member 27 generally exists in a vertical plane between the end plates 24. In other embodiments, the longitudinal members 27 may have some lateral extent.

The grip members 30 in FIGS. 19-23 are in the form of a plurality of elongated grips 33 that are directly connected to the inner surfaces of the longitudinal members 27, such as via fasteners or other joining technique. The barbell 10 of FIGS. 19-23, has grips 33 that extend perpendicular to the longitudinal members 27, as well as grips 32 that extend at a non-perpendicular transverse angle to the longitudinal members 27. The grips 33 in this configuration are connected to both side portions 54, 55 of the frame 22 and extend between the side portions 54, 55. The barbell 10 in the embodiment of FIGS. 19-23 is similar to the barbell 10 in the embodiment of FIGS. 8-12 in many other aspects, but the end plates 24 and the mounting structure 40 in the embodiment of FIGS. 19-23 is different from the embodiment of FIGS. 8-12.

The end plates 24 in the embodiment of FIGS. 19-23 each have an opening 29 therethrough. In the embodiment of FIGS. 19-23, the openings 29 are circular and defined completely within the end plates 24, but may have a different shape and/or a slot-like configuration in another embodiment. Each of the end plates 24 in FIGS. 19-23 has a central section 24A that is perpendicular to the central longitudinal axis (X) of the barbell 10 and has the opening 29 defined therein, and end sections 24B that are angled with respect to the central section 24A. The end sections 24B extend from the central section 24A inward toward the lateral centerline of the barbell 10 and outward from the longitudinal centerline of the barbell and connect to the distal ends of the longitudinal members 27. In the configuration illustrated in FIGS. 19-23, the end sections 24B connect to the ends of the end sections 27C of the longitudinal members 27, but the frame 22 may have a different configuration in another embodiment. For example, the frame 22 may also include angled members 28 at the ends of the longitudinal members 27, such as in the embodiment of FIGS. 8-12, that are connected to the end sections 24B of the end plates 24.

The mounting structure 40 in the barbell 10 of FIGS. 19-23 includes tubular members 41 located at each end 25, 26 of the central section 20 and configured for connection of the barbell sections 12, 14, which are configured as described herein with respect to FIGS. 1-12. The tubular members 41 are connected to the end plates 24, such that the tubular members 41 are received within the openings 29 in the end plates 24 and extend through the end plates 24. The mounting structure 40 in FIGS. 19-23 also includes brace members 42 each connected to the frame 22 and one of the tubular members 41 to further secure the connection of the tubular members 41. Each brace member 42 in FIGS. 19-23 has two legs 43 that are connected to the frame 22 as described herein, with a mounting plate 44 connected to the legs 43. The mounting plate 44 and the legs 43 in this embodiment are formed as a single planar plate that extends perpendicular to the central longitudinal axis (X) of the barbell 10 and is connected to the end sections 27C of the longitudinal members 27. The legs 43 extend inwardly toward the longitudinal centerline of the barbell 10, such that the angled legs 43 are perpendicular to the longitudinal members 27 and the axes of the tubular members 41 and parallel to the lateral axis (Y) of the barbell 10. Each mounting plate 44 has an opening 45 that receives a portion of the tubular member 41 therethrough, as described herein with respect to FIGS. 1-12. The inner ends 47 of the tubular members 41 may be substantially flush with the inner surfaces of the mounting plates 44 in one embodiment. The tubular members 41 may be connected to the end plates 24 and the mounting plates 44 by welding or other integral joining technique in one embodiment, and it is understood that other connection techniques and/or mechanical mating techniques may additionally or alternately be used.

Each tubular member 41 in the embodiment of FIGS. 19-23 may be configured in the same manner as the tubular member 41 described herein with respect to FIGS. 1-12. Each barbell section 12, 14 may also be configured in the same manner as the barbell sections 12, 14 described herein with respect to FIGS. 1-12. In this configuration, each bar portion 15 has a proximal end 17 that extends through the tubular member 41 for connection to the central section 20. The proximal end 17 has a connection portion 18 configured for connection to a fastener 19 to connect the bar portion 15 to the central section 20.

FIGS. 24-28 illustrate another embodiment of a barbell 10, in which the frame 22 and the grip members 30 of the central section 20 are configured differently from the barbells 10 of FIGS. 1-23. The frame 22 in FIGS. 24-28 is configured similarly or identically to the frame 22 in the embodiment of FIGS. 1-7, except that one of the longitudinal members 27 of the frame 22 in FIGS. 24-28 is split into two longitudinal sections 50 to create a gap or opening 52 in the frame 22 on a first side portion 54. Each of the longitudinal sections 50 extends from the gap 52 parallel to the other longitudinal member 27 on the second side portion 55 of the frame 22, toward the respective end 25, 26 of the frame 22. Each longitudinal section 50 in FIGS. 24-28 is connected to an angled member 28 at the distal end thereof, although the longitudinal sections 50 may be connected directly to the end pieces 24 in another embodiment. The other (continuous) longitudinal member 27 on the second side portion 55, the angled members 28, and the end pieces 24 in the embodiment of FIGS. 24-28 are similar to the longitudinal member 27, the angled members 28, and the end pieces 24 in the embodiment of FIGS. 1-7. As such, the end pieces 24 in the embodiment of FIGS. 24-28 are in the form of end plates as described herein. Also, similarly to the embodiments of FIGS. 1-12, the longitudinal members 27 and the angled members 28 in this embodiment are formed of square tubing (e.g., 1.5"×1.5"). The mounting structure 40 and the barbell sections 12, 14 in the barbell 10 of FIGS. 24-28 are similar or identical to the mounting structure 40 and the barbell sections 12, 14 in the barbells 10 of FIGS. 1-12. Thus, these components will not be described again in detail for the sake of brevity.

The grip members 30 in FIGS. 24-28 are in the form of a plurality of elongated grips 33 that are directly connected to the inner surfaces of the longitudinal members 27, such as via fasteners or other joining technique. The grips 33 in this configuration are connected to both side portions 54, 55 of the frame 22 and extend between the side portions 54, 55. The barbell 10 of FIGS. 24-28, has grips 33 that extend perpendicular to the longitudinal members 27, as well as grips 32 that extend at a non-perpendicular transverse angle to the longitudinal members 27. The grip members 30 in FIGS. 24-28 are removable and reconnectable in various arrangements, as discussed herein with respect to other embodiments. The barbell 10 in the embodiment of FIGS. 24-28 also includes transverse members 53 extending between and permanently connected to the longitudinal members 27, which are configured as grips in this configuration. The transverse members 53 in this embodiment are rounded or otherwise contoured for gripping and/or may include knurling or other grip-enhancing structures. In the embodiment of FIGS. 24-28, the transverse members 53 are angled obliquely with respect to the longitudinal and lateral axes (X,Y) of the frame 22 and with respect to the longitudinal members 27. In this configuration, the transverse members 53 are closer together at the second side portion 55 of the frame 22 and diverge away from each other toward the first side portion 54, making the gap 52 wider at the first side portion 54 and narrower at the second side portion 55. In another embodiment, the transverse members 53 may be oriented to be perpendicular to the longitudinal members 27 and the longitudinal axis (X). The transverse members 53 are permanently connected to the longitudinal members 27 in the embodiment of FIGS. 24-28, such as by welding or other integral joining technique, but may be removably connected in another embodiment. It is understood that the transverse members 53 may not be configured or intended specifically for gripping in another embodiment.

Figure 24:
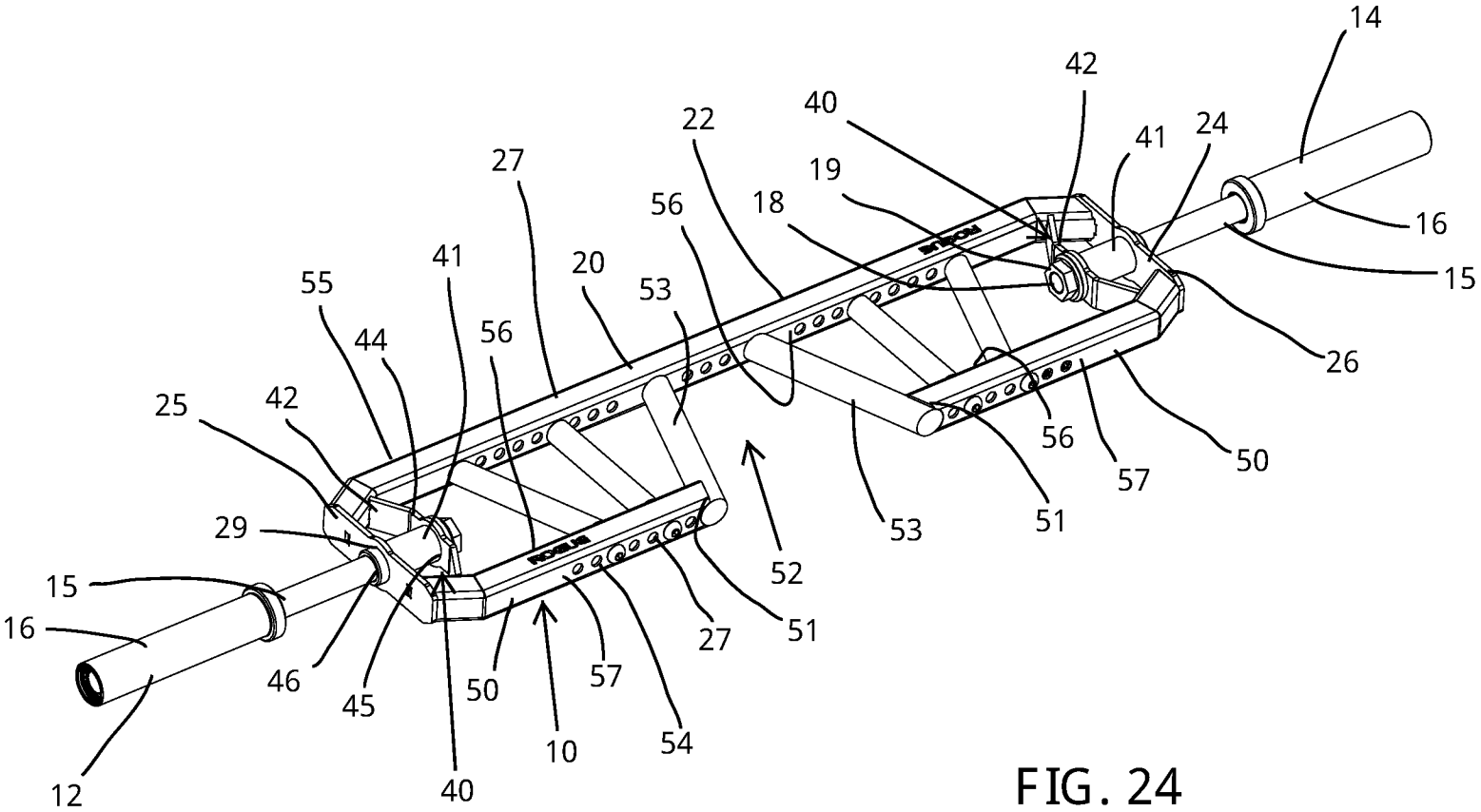
FIG. 24 is a perspective view of another embodiment of a barbell according to aspects of the present disclosure.
Figure 25:
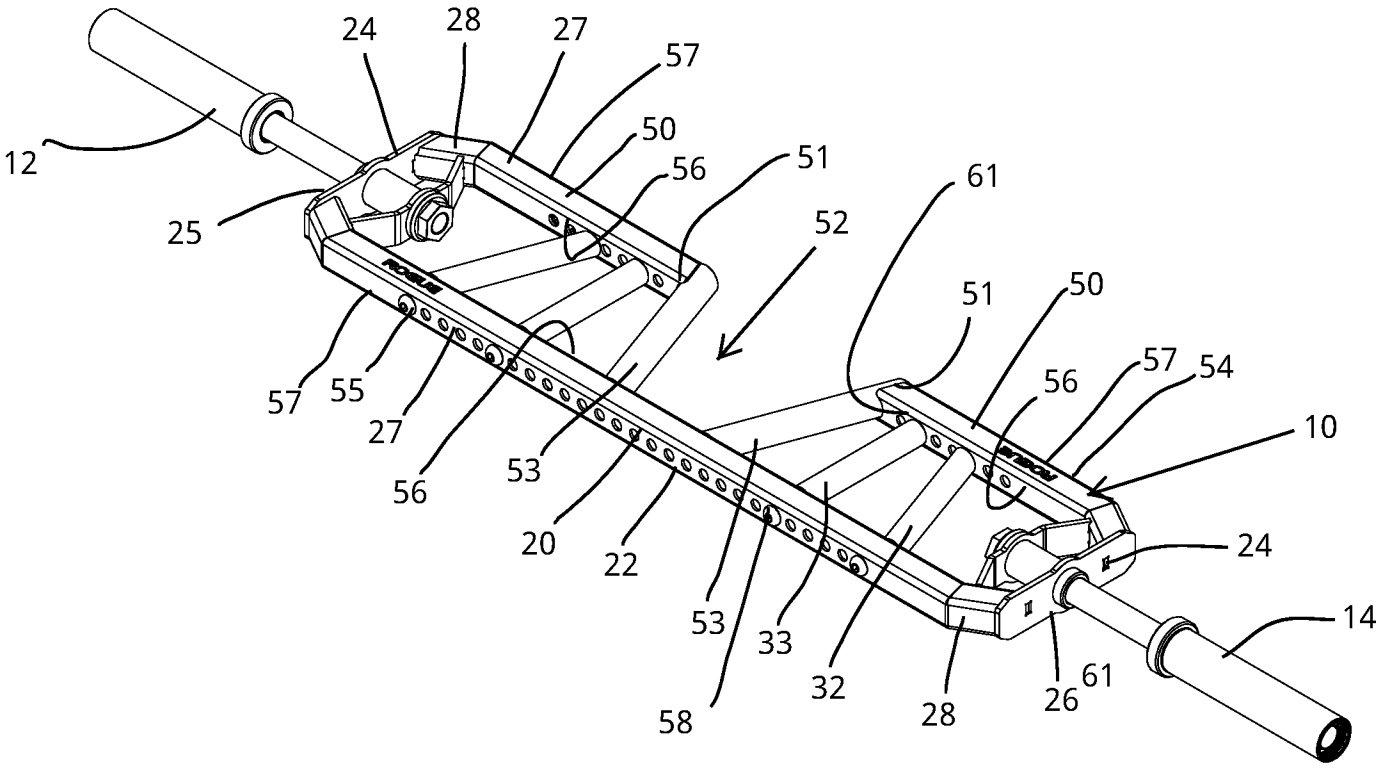
FIG. 25 is a bottom perspective view of the barbell of FIG. 24.
Figure 26:
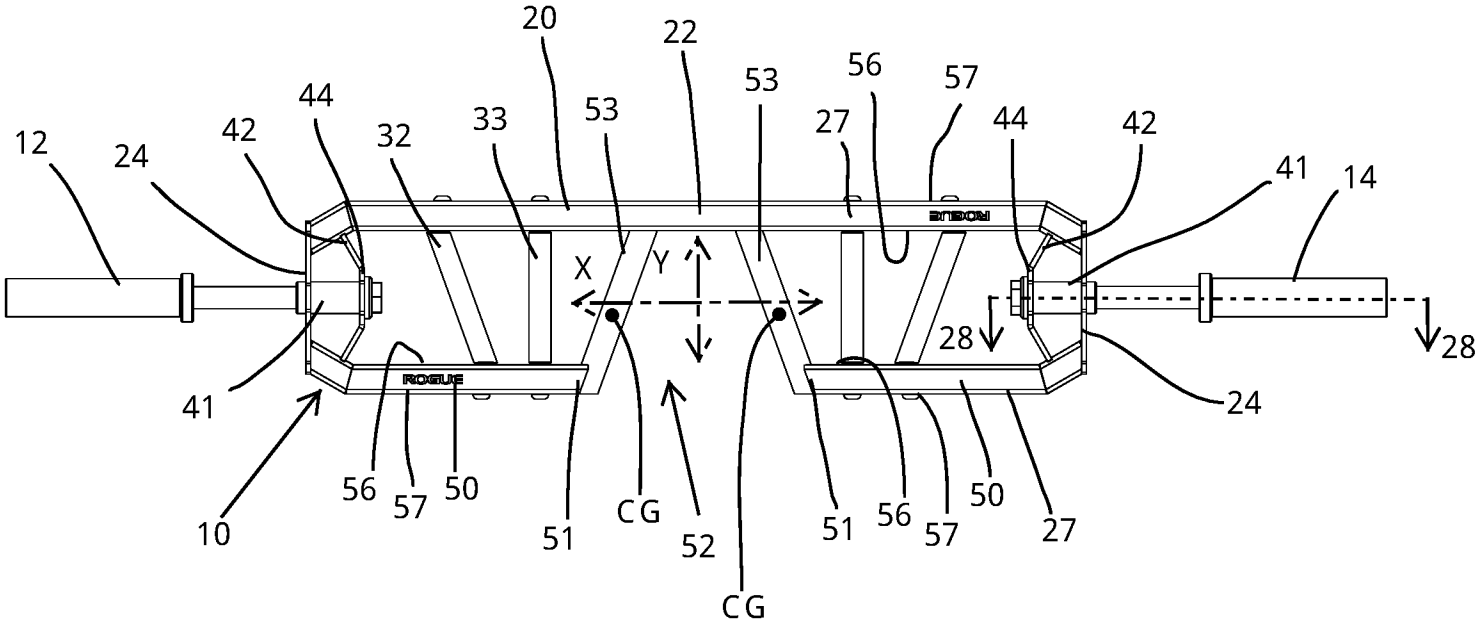
FIG. 26 is a top view of the barbell of FIG. 24.
Figure 27:
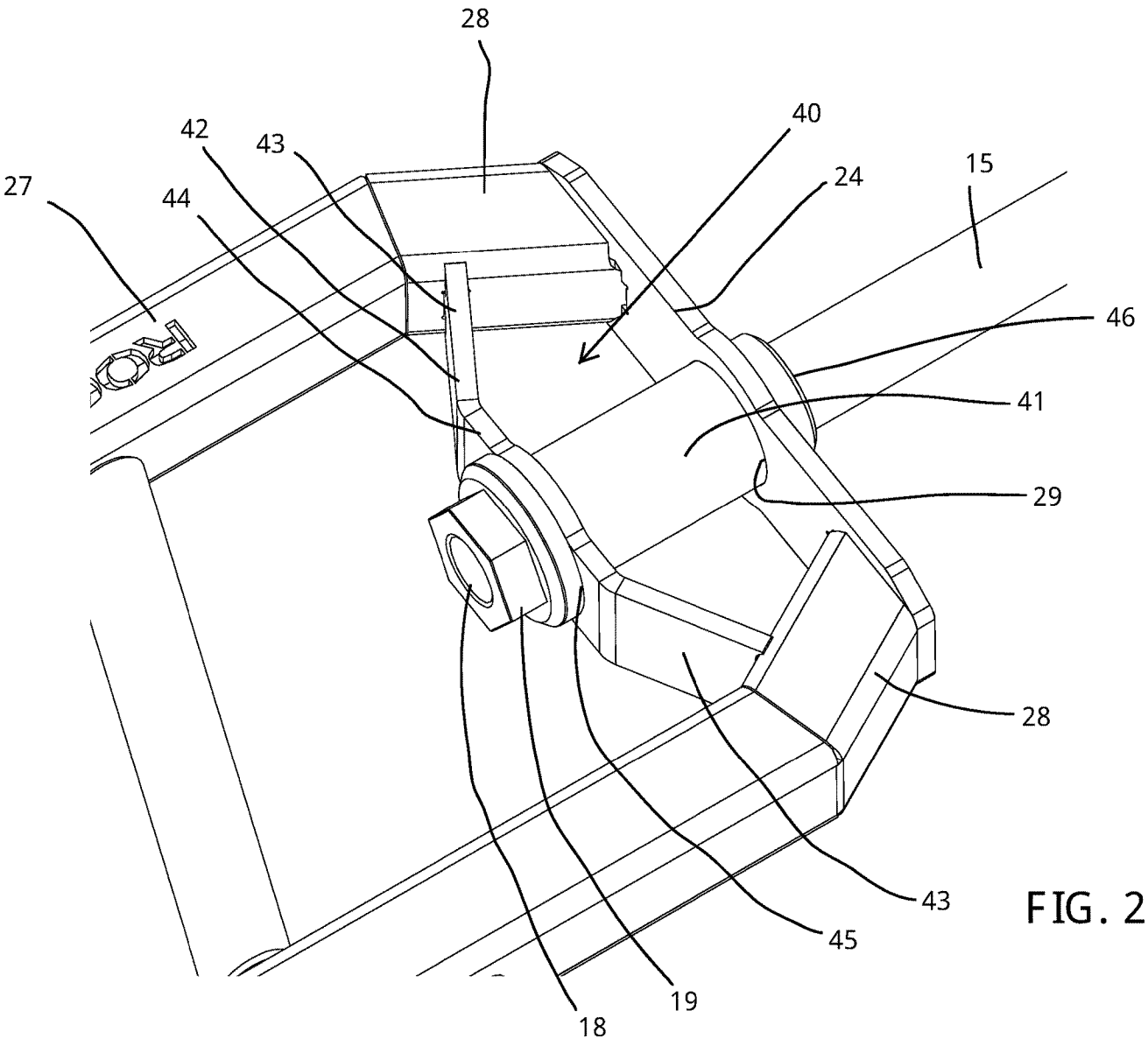
FIG. 27 is a magnified perspective view of a portion of the barbell of FIG. 24.
Figure 28:
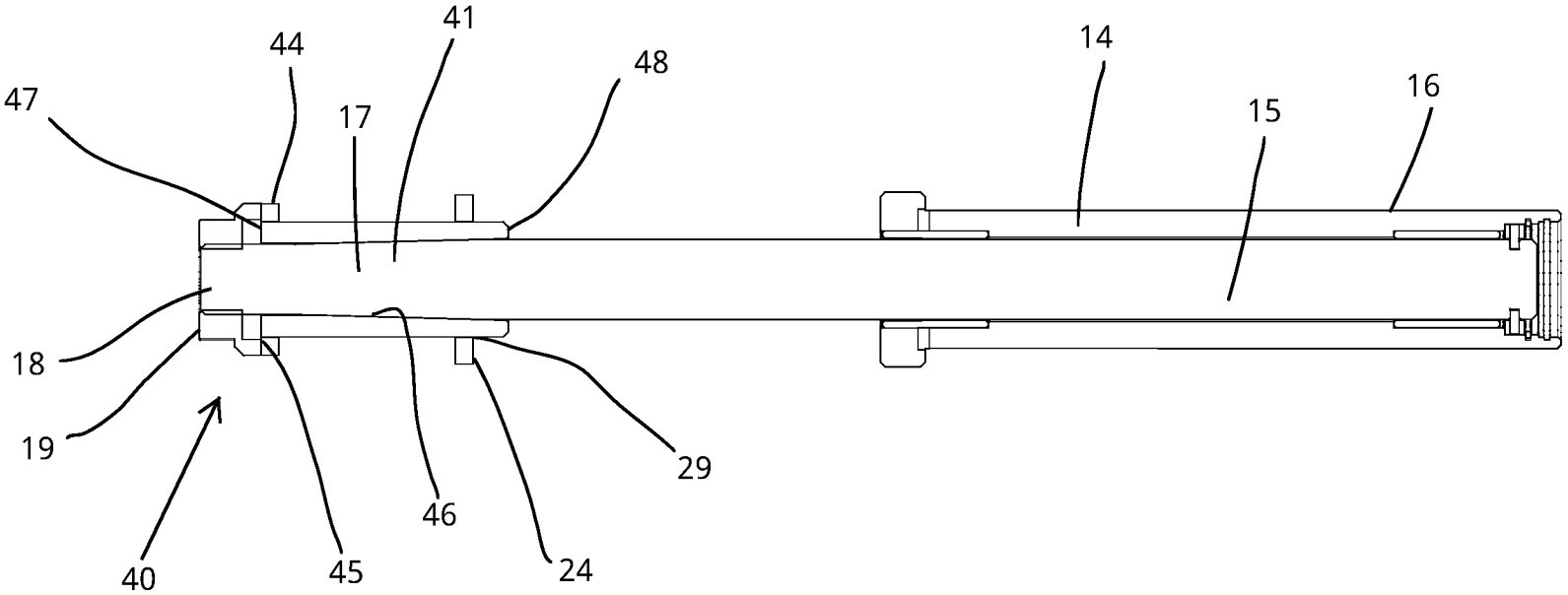
FIG. 28 is a cross-section view of the barbell of FIG. 24 taken along lines 28-28 of FIG. 26.
Figure 29:
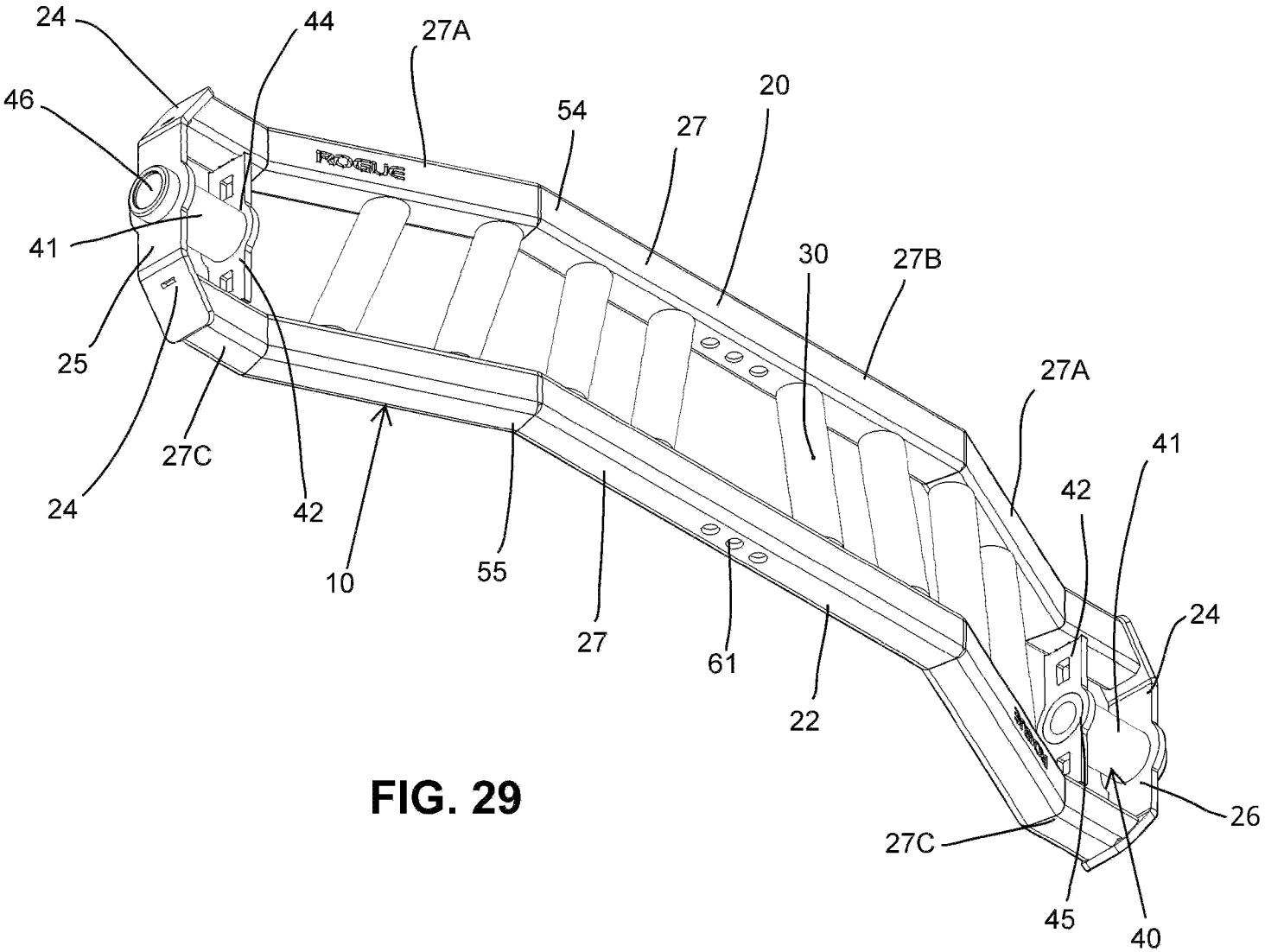
FIG. 29 is a perspective view of another embodiment of a portion of a barbell according to aspects of the present disclosure.
Figure 30:
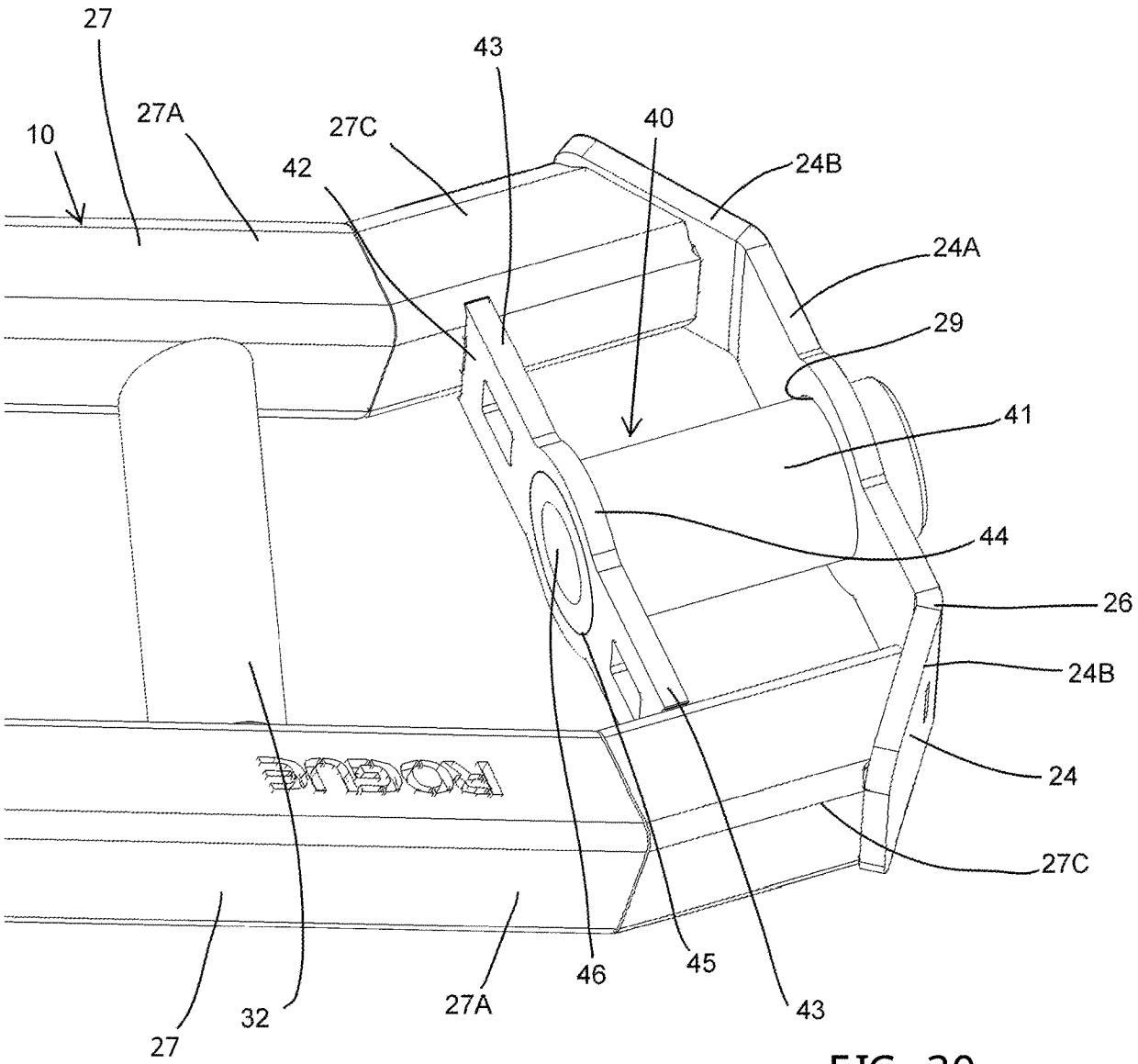
FIG. 30 is a magnified perspective view of a portion of the barbell of FIG. 29.
Figure 31:
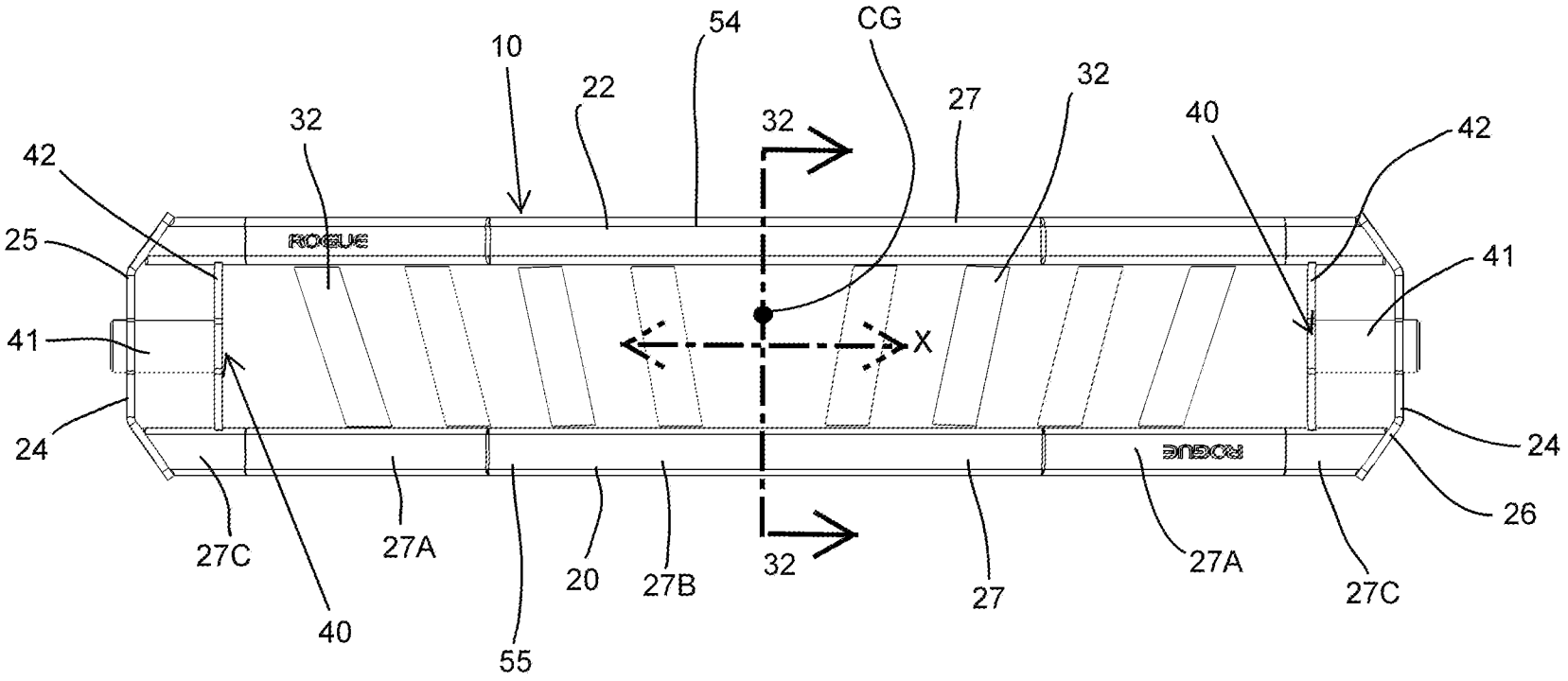
FIG. 31 is a top view of the barbell of FIG. 29.
Figure 32:
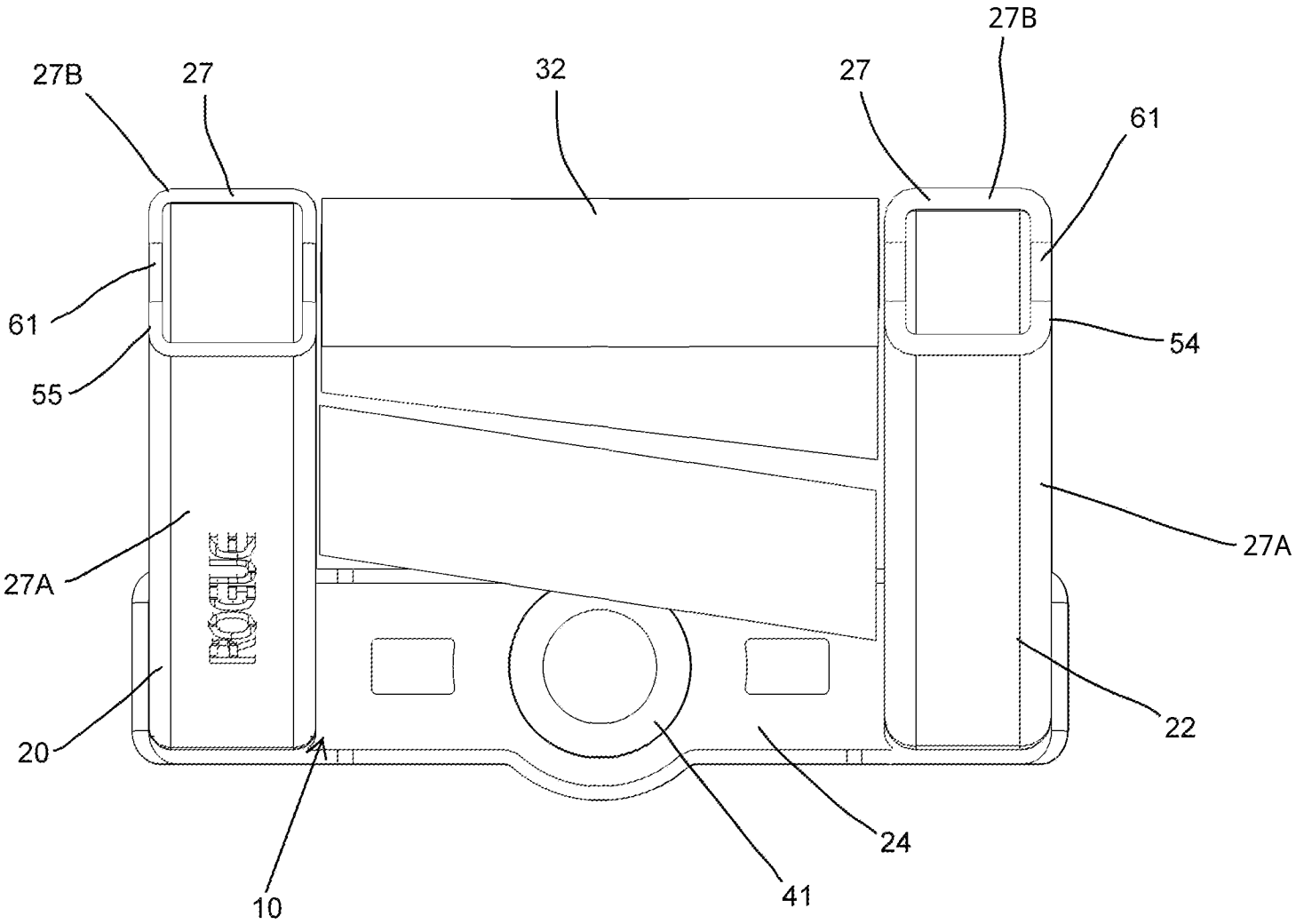
FIG. 32 is a cross-section view of the barbell of FIG. 29 taken along lines 32-32 of FIG. 31.
Figure 33:
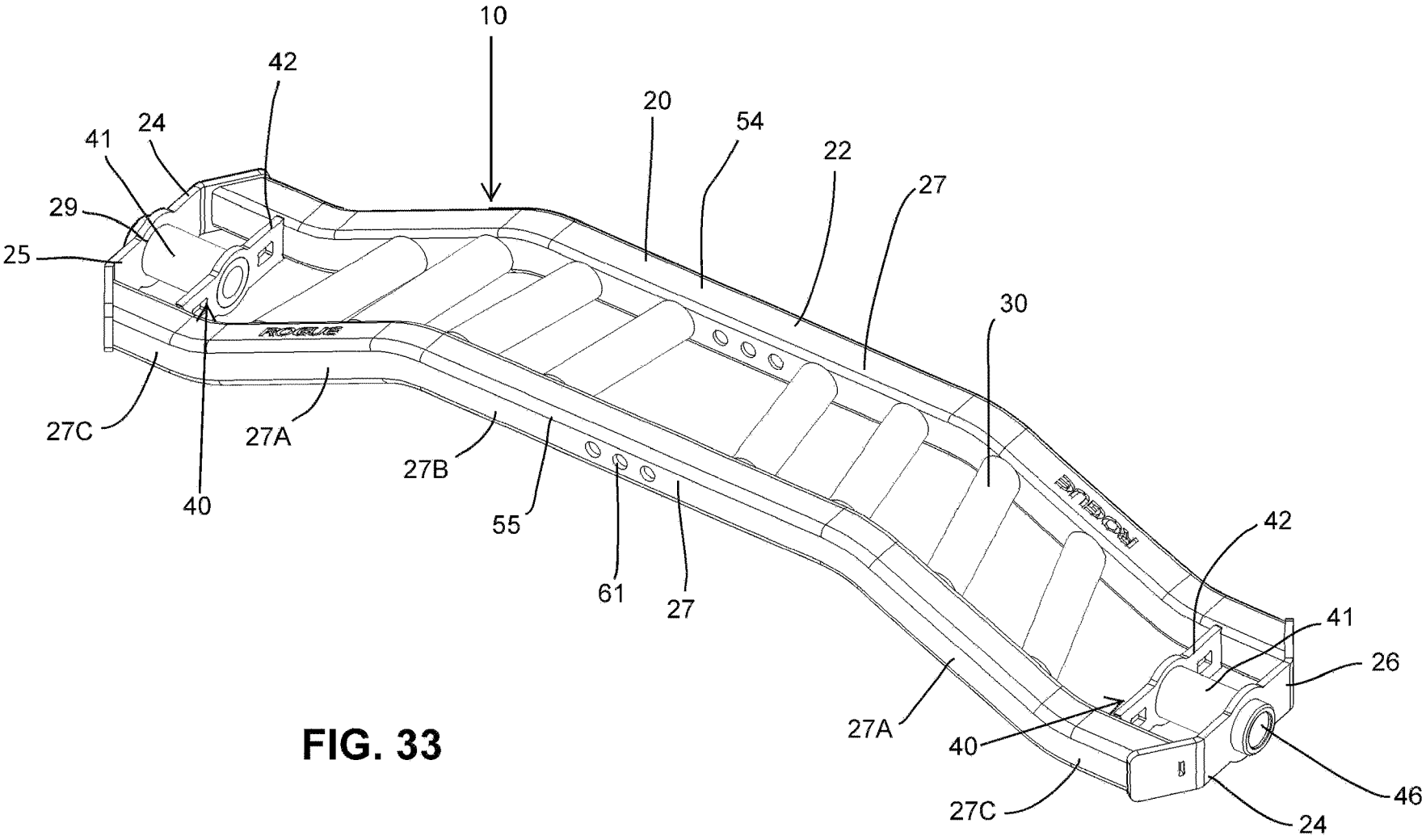
FIG. 33 is a perspective view of another embodiment of a portion of a barbell according to aspects of the present disclosure.
Figure 34:
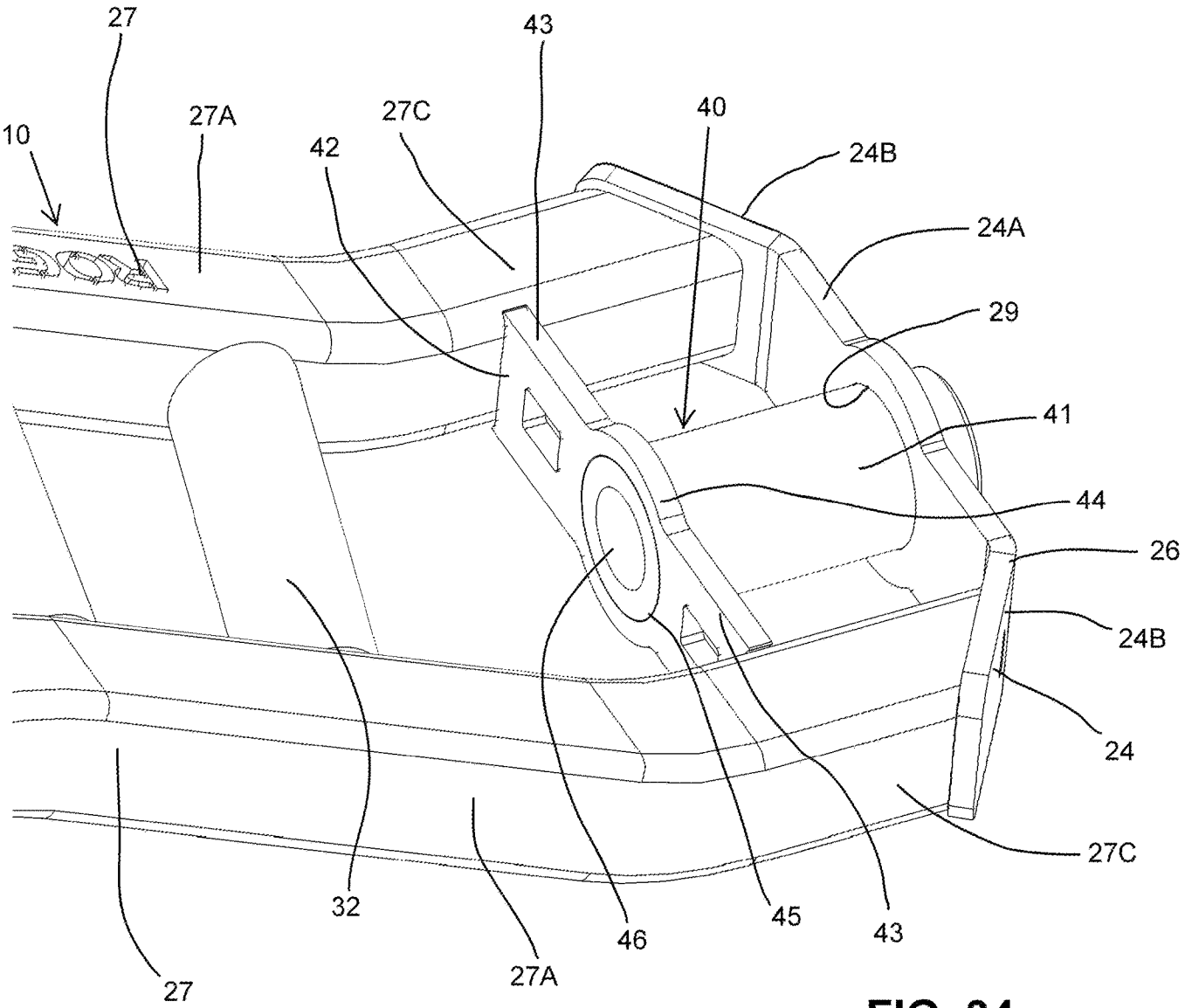
FIG. 34 is a magnified perspective view of a portion of the barbell of FIG. 33.
Figure 35:
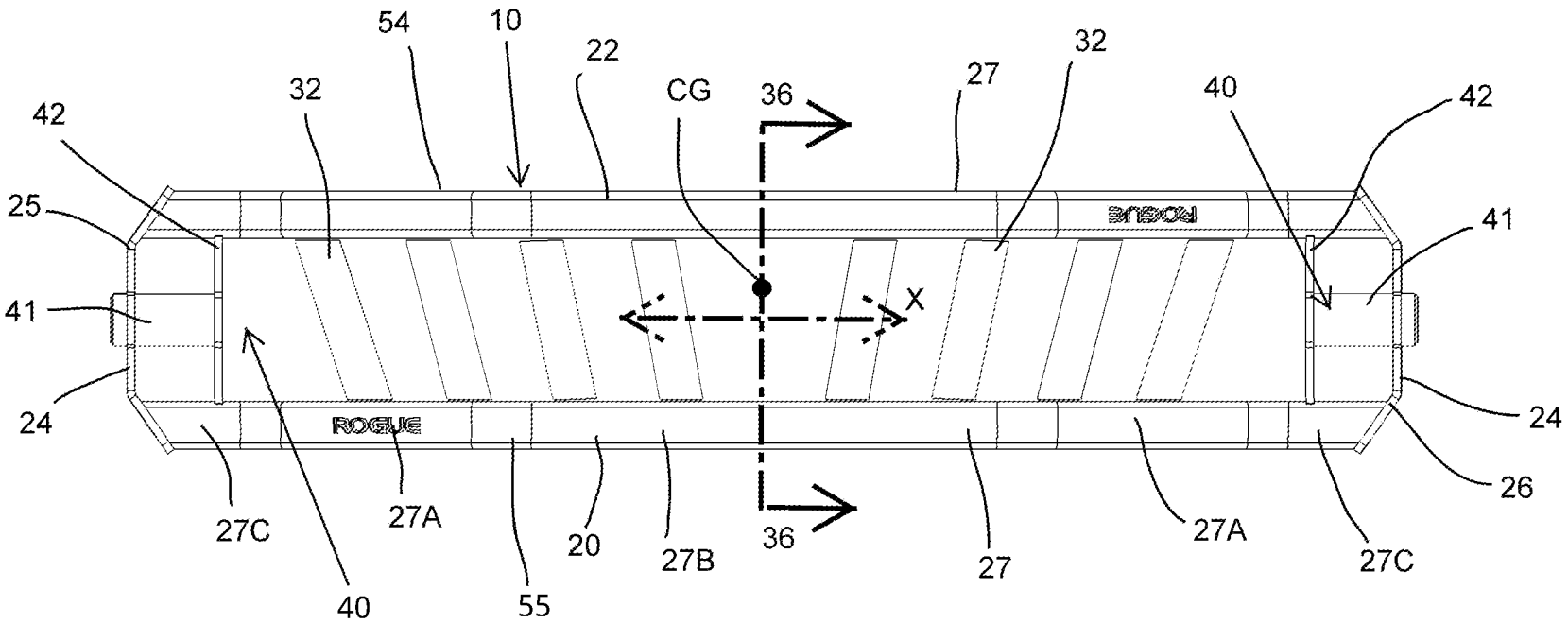
FIG. 35 is a top view of the barbell of FIG. 33.
Figure 36:
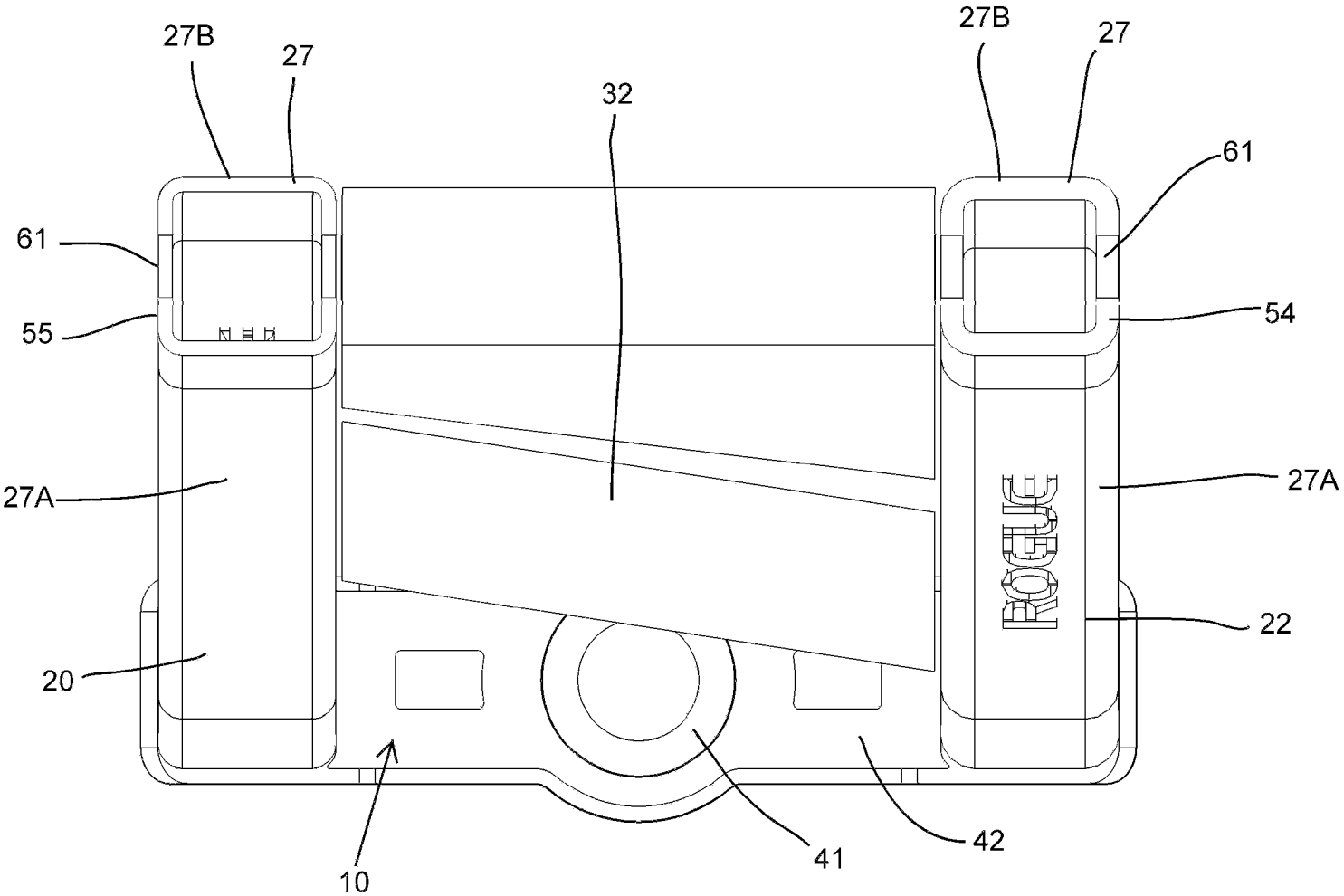
FIG. 36 is a cross-section view of the barbell of FIG. 33 taken along lines 36-36 of FIG. 35.

Additionally, the transverse members 53 may be configured to have a center of mass or center of gravity (CG) that is offset from the longitudinal axis (X) of the barbell 10, in order to compensate for the missing material in the gap 52 and thereby balance the weight of the barbell 10. In the embodiment of FIGS. 24-28, the transverse members 53 extend further away from the longitudinal axis (X) on the first side portion 54 of the frame 22, i.e., the side with the gap 52, than on the second side portion 55 of the frame 22. As shown in FIGS. 24-26, the transverse members 53 are connected to an inward-facing surface 56 of the longitudinal member 27 (i.e., facing the longitudinal centerline of the barbell 10) on the second side 55 and are connected to proximal ends 51 of the longitudinal sections 50. In this configuration, the transverse members 53 extend past the inward-facing surfaces 56 of the longitudinal sections 50 and extend approximately to the outward-facing surfaces 57 of the longitudinal sections 50 (i.e., facing away from the longitudinal centerline of the barbell 10). The ends of the transverse members 53 may be substantially flush with the outward-facing surfaces 57 of the longitudinal sections 50. The transverse members 53 in this configuration are shifted toward the first side 54 of the frame 22, both in position and mass, such that the center of gravity (CG) of each transverse member 53 is offset toward the first side portion 54 of the frame 22. In another embodiment, the transverse members 53 may achieve an offset center of gravity (CG) without positional offset, such as by including differential weighting (i.e., multi-material construction or a weight insert proximate the first side portion 54) or having a shape that increases weight toward the first side portion 54 (i.e., greater width or thickness). In a further embodiment, the frame 22 may include a different structure to achieve counterweighting to balance the loss of mass in the gap 52, such as by using weighted inserts, differently gauged materials, or added structures on the frame 22.

FIGS. 29-38 illustrate additional embodiments of a barbell 10, in which the central section 20 and/or the frame 22 is configured to be differentially or offset weighted such that a center of mass or center of gravity (CG) of the central section 20 is offset from the central longitudinal axis (X) of the barbell 10, to improve the balance of the barbell 10 during use. The barbells 10 in FIGS. 29-38 are shown without the barbell sections 12, 14, but it is understood that the barbell sections 12, 14 as described herein with respect to other embodiments may be mounted to the central section 20 using the mounting structure 40 as described herein. Differential weighting of the barbell 10 so the center of gravity (CG) is not located along the central longitudinal axis (X) increases the stability of the barbell 10 during use and reduces oscillation that can result from strength differences between medial and lateral deviators in the user's wrists. Typically, a user's lateral deviators are stronger than the medial deviators. For this reason, the barbells 10 of FIGS. 29-38 are differentially weighted such that the center of gravity (CG) is shifted toward the ulnar side of the user's wrist during typical use. However, a barbell 10 with the center of gravity (CG) shifted toward the radial side of the user's wrist may also increase stability during typical use.

The barbell 10 in FIGS. 29-32 has a frame 22 that is generally configured similarly to the frame 22 of the barbell 10 in FIGS. 19-23. In this embodiment, the longitudinal members 27 of the frame 22 have an arched or cambered configuration that arches upward from both ends 25, 26 toward the longitudinal middle of the frame 22, with inclined sections 27A that extend upward from the ends 25, 26 to a raised section 27B in the middle of the longitudinal length of the frame 22. The inclined sections 27A in this embodiment are linearly angled with respect to the raised section 27B and with respect to the central longitudinal axis (X) of the barbell 10, as defined by the axes of the barbell sections 12, 14. This configuration is formed by welding a plurality (i.e., five) laser-cut tubular beams together to form each longitudinal member 27. Each raised section 27B in this embodiment is a straight linear section that extends longitudinally parallel to the central longitudinal axis (X) of the barbell 10, as defined by the axes of the barbell sections 12, 14. The inclined sections 27A form obtuse angles with respect to the raised section 27B and the central longitudinal axis (X) of the barbell 10. The pieces of tubing forming the longitudinal members 27 in the embodiment of FIGS. 29-32 are square tubing (e.g., 1.5"×1.5"), which differs from the rectangular tubing used in the embodiment of FIGS. 19-23.

The differential weighting of the barbell 10 of FIGS. 29-32 is provided by using thicker gauge tube for the longitudinal member 27 on the first side portion 54 of the frame 22 and lighter-gauge tube for the longitudinal member 27 on the second side portion 55 of the frame 22. For example, the longitudinal member 27 on the first side portion 54 of the frame 22 may be formed of metal tube with a 3/16 inch wall thickness (i.e., 7 gauge tube), and the longitudinal member 27 on the second side portion 55 of the frame 22 may be formed of metal tube with a 1/8 inch wall thickness (i.e., 11 gauge tube). In one embodiment, each longitudinal member 27 (including all pieces forming the same) has a consistent wall thickness over its entire length. In another embodiment, a portion of each longitudinal member 27 may be formed of a thicker or thinner gauge tube. For example, the longitudinal member 27 on the first side portion 54 of the frame 22 may have a portion with a high wall thickness and a portion with an intermediate wall thickness, and the longitudinal member 27 on the second side portion 55 of the frame 22 may have a portion with a low wall thickness and a portion with an intermediate wall thickness. It is understood, as described elsewhere herein, that a different weighting configuration may be used, such as using a thicker-gauge tube on the second side portion 55 of the frame 22 and a lighter-gauge tube on the first side of the frame 22.

The frame 22 in FIGS. 29-32 has end pieces 24 in the form of end plates that extend between the distal ends of the longitudinal members 27 and are connected to the longitudinal members 27. Each longitudinal member 27 in FIGS. 29-32 has end sections 27C extending longitudinally parallel to the central longitudinal axis (X) of the barbell 10 and extending between the distal ends of the inclined sections 27A and the end plates 24. The end plates 24 are connected to the end sections 27C and extend between the end sections 27C in this embodiment. The longitudinal members 27 in FIGS. 29-32 are parallel to each other over their entire lengths, and each longitudinal member 27 generally exists in a vertical plane between the end plates 24. In other embodiments, the longitudinal members 27 may have some lateral extent.

The grip members 30 in FIGS. 29-32 are in the form of a plurality of elongated grips 33 that are directly connected to the inner surfaces of the longitudinal members 27 by welding or other integral joining technique. The barbell 10 of FIGS. 29-32 has grips 33 that extend at a non-perpendicular transverse angle to the longitudinal members 27. The longitudinal members 27 in the embodiment of FIGS. 29-32 have openings 61 only near the center of the frame 22, while the barbell 10 of FIGS. 19-23 has openings 61 along substantially the entire length of each longitudinal member 27 to provide for adjustment of the grip members 30 along the frame 22. However, it is understood that the longitudinal members 27 in FIGS. 29-32 may be provided with openings 61 for connection of adjustable grip members 30 in another embodiment, such as via fasteners or other joining technique as described elsewhere herein.

The end plates 24 and the mounting structure 40 of the barbell 10 in FIGS. 29-32 are similar or identical to the end plates 24 and the mounting structure 40 of the barbell 10 in FIGS. 19-23, including the structures of the tubular members 41 and the brace members 42. These structures will not be described again in detail with respect to the embodiment of FIGS. 29-32, but may be referenced in the drawings using the same reference numbers used in the description herein of the embodiment of FIGS. 19-23. It is understood that the barbell sections 12, 14 and fasteners 19 are not shown in FIGS. 29-32, but that the barbell sections 12, 14 and fasteners 19 shown and described herein with respect to other embodiments may be used in this embodiment as well.

FIGS. 33-36 illustrate another embodiment of a barbell 10 that is structurally similar to the barbell 10 of FIGS. 29-32 and includes the same features as the barbell 10 of FIGS. 29-32. These common features are not described again in detail for the sake of brevity, but may be referenced herein and in the drawings using similar reference numbers. The barbell 10 in FIGS. 33-36 has each longitudinal member 27 formed of a single piece of a square metallic tube that is bent to form the inclined sections 27A, the raised section 27B, and the end sections 27C of each longitudinal member 27. In this configuration, the angular junctions between the inclined sections 27A, the raised section 27B, and the end sections 27C are smoothly curved, forming angles that are approximately the same as the angles in the barbell 10 of FIGS. 29-32. The cross-sectional dimensions of the longitudinal members 27 in FIGS. 33-36 are the same as those in the embodiment of FIGS. 29-32, as described above, incorporating thicker-gauge tube for the longitudinal member 27 on the first side portion 54 of the frame 22 and lighter-gauge tube for the longitudinal member 27 on the second side portion 55 of the frame 22. For example, the longitudinal member 27 on the first side portion 54 of the frame 22 may be formed of metal tube with a 3/16 inch wall thickness (i.e., 7 gauge tube), and the longitudinal member 27 on the second side portion 55 of the frame 22 may be formed of metal tube with a 1/8 inch wall thickness (i.e., 11 gauge tube). As described herein, each longitudinal member 27 may have a consistent or varying wall thickness over its length, in various embodiments. As also described herein, a different weighting configuration may be used in another embodiment, such as using a thicker-gauge tube on the second side portion 55 of the frame 22 and a lighter-gauge tube on the first side of the frame 22.

Figure 37:
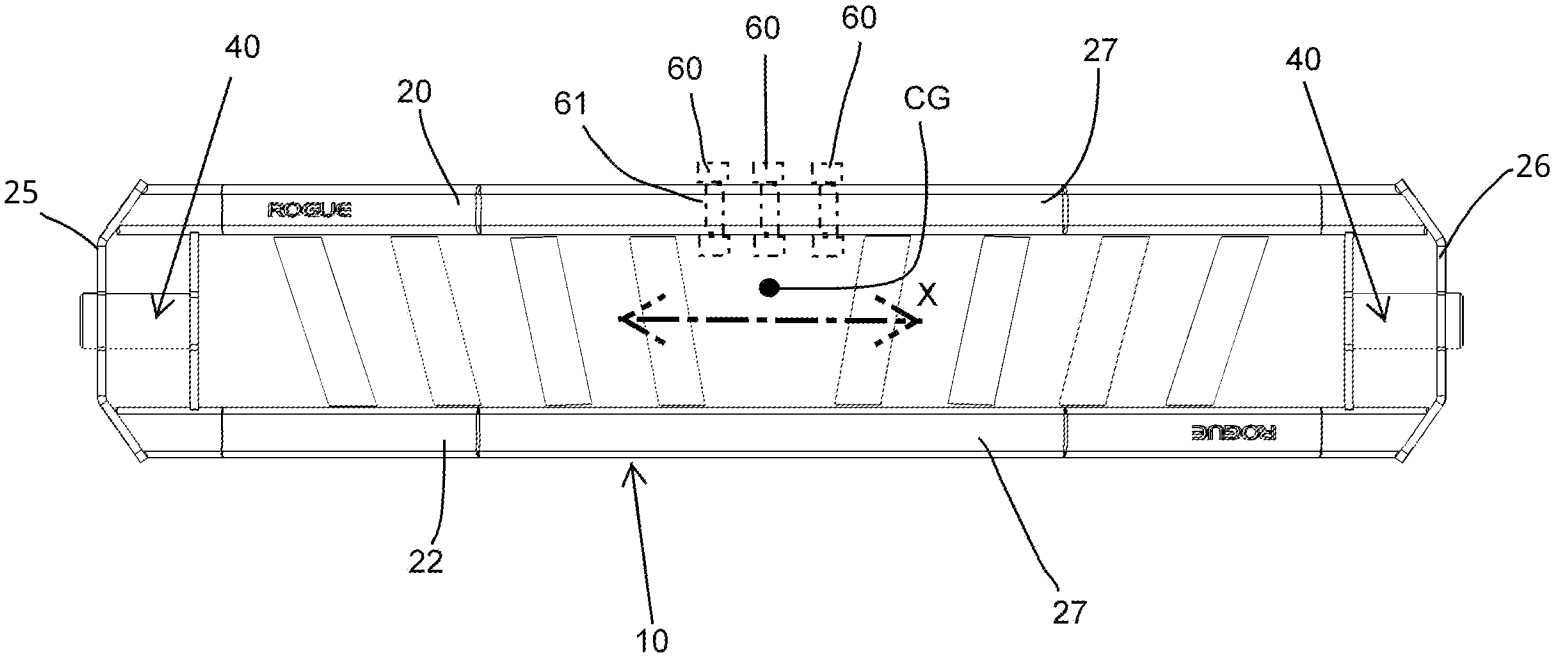
FIG. 37 is a top view of another embodiment of a portion of a barbell according to aspects of the present disclosure, with weights shown schematically in broken lines.
Figure 38:
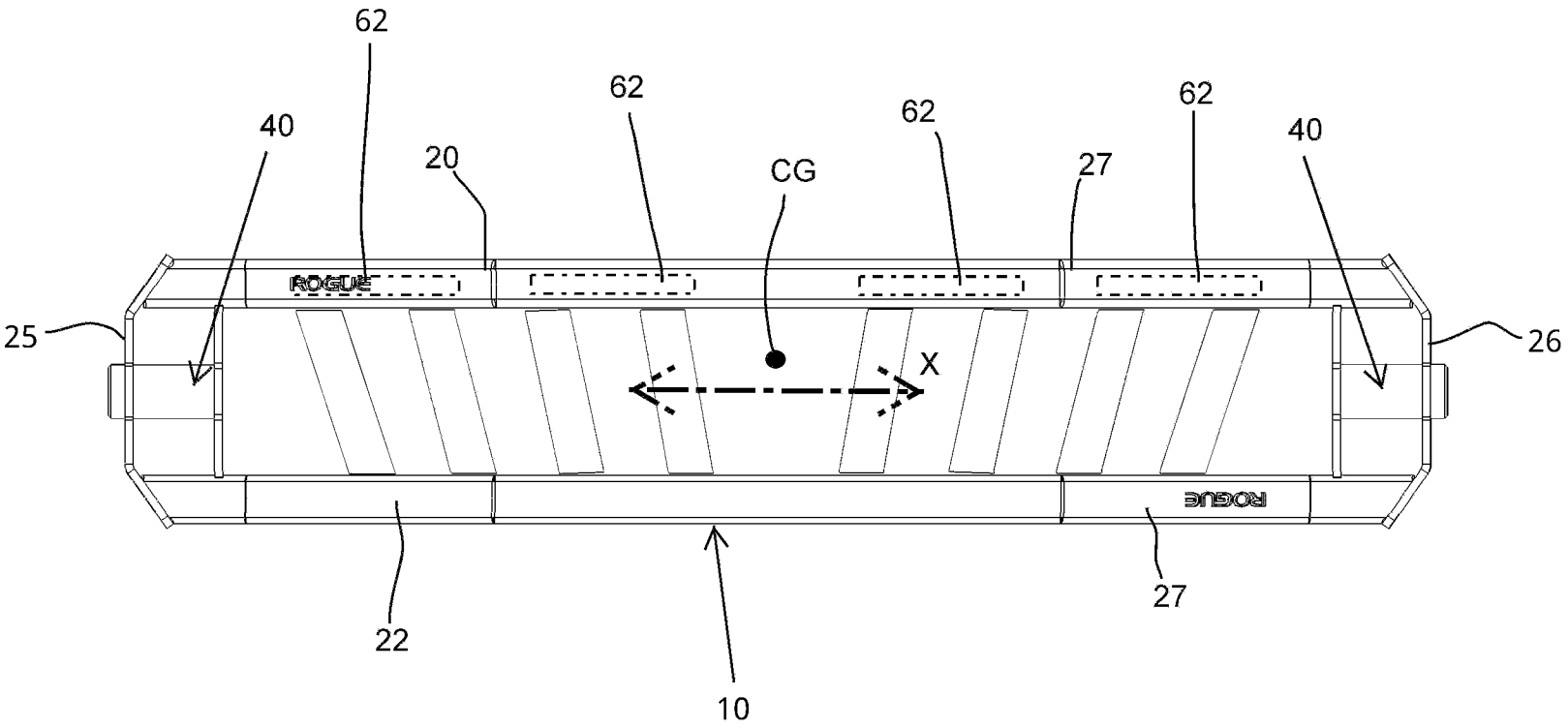
FIG. 38 is a top view of another embodiment of a portion of a barbell according to aspects of the present disclosure, with weights shown schematically in broken lines.

FIGS. 37-38 illustrate additional embodiments of barbells 10 that are structurally similar to the barbell 10 of FIGS. 29-32 and includes the same external structural features as the barbell 10 of FIGS. 29-32. In the embodiments of FIGS. 37-38 the differential weighting of the barbell 10 is not accomplished using different thicknesses of tube material for the longitudinal members 27. Instead, the barbells 10 in FIGS. 37-38 use the same tube material on both the first and second side portions 54, 55, and the differential weighting is achieved by the use of separate weights that are connected to the barbell 10. The weights in these embodiments may be formed at least partially or entirely of a material that is more dense than the material forming the longitudinal members 27 and/or other portions of the frame 22.

The barbell 10 in FIG. 37 includes removable weights 60 that are inserted through openings 61 in the longitudinal members 27. The removable weights 60 may be fixed within the openings 61 using fasteners or other removable connection structures. Removable weights 60 as described herein may be used in connection with other embodiments of barbells 10 disclosed herein, including any of the barbells 10 in FIGS. 1-28, such as by inserting the removable weights 60 in the openings 61 used for connection of the grip members 30. In another embodiment, the barbell 10 may use fasteners with different weights for connecting the grip members 30 to the frame 22, to create a weight offset for the barbell 10. For example, fasteners that are heavier (e.g., larger and/or made from a higher density material) may be used on one of the first and second side portions 54, 55 of the frame 22, and fasteners that are lighter (e.g., smaller and/or made from a lower density material) may be used on the other of the first and second side portions 54, 55 of the frame 22.

The barbell 10 in FIG. 38 includes one or more internal weights 62 that are located within the tube forming at least one of the longitudinal members 27. In the embodiment of FIG. 38, multiple internal weights 62 are connected to one of the longitudinal members 27 and not to the other longitudinal member 27, creating an offset weight distribution. Such weights 62 may be permanently fixed within the longitudinal member(s) 27 in one embodiment, such as by welding, adhesive or other bonding material, or another integral joining technique. Such weights 62 may be removably fixed within the longitudinal member(s) 27 in another embodiment, such as by a releasable bonding material, magnets, fasteners, or other removable joining technique. For example, fasteners inserted through the openings 61 may be used to removably fix the internal weights 62 within the longitudinal member(s) 27. In a further embodiment, the .weights 62 may be located on the exterior surface of the frame 22, rather than within the tube, and may be connected using similar techniques. In another embodiment, grip members 30 with offset weighting may be used to create a weight differential for the barbell 10, e.g., where one end of the grip member 30 is heavier than the other.

The structures and components disclosed herein for use in creating differential weighting configurations for the barbells 10 of FIGS. 29-38 may also be used in connection with other embodiments of barbells 10 disclosed herein, including the embodiments in FIGS. 1-28. For example, any of the embodiments of FIGS. 1-28 may use higher wall thickness tube on one longitudinal member 27 and lower wall thickness tube on the other longitudinal member 27 and/or any of the weights 60, 62 discussed herein. It is understood that other structures and configurations may be used to create a differential or offset weighting for the barbell 10 to achieve a similar functionality.

Various embodiments of barbells have been described herein, which include various components and features. In other embodiments, the barbells may be provided with any combination of such components and features. It is also understood that in other embodiments, the various devices, components, and features of the barbells described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. When used in description of a method or process, the term "providing" (or variations thereof) as used herein means generally making an article available for further actions, and does not imply that the entity "providing" the article manufactured, assembled, or otherwise produced the article. The terms "approximately" and "substantially" as used herein implies a variation of up to 10% of the nominal value or property modified by such term, or up to 10% of a midpoint value of a range modified by such term. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A barbell comprising:

a central section comprising a frame including a plurality of frame members extending between opposed first and second ends of the central section, a first end piece connected to the frame at the first end of the central section, and a second end piece connected to the frame at the second end of the central section;

a mounting structure comprising a first tubular member located at the first end of the central section, the first tubular member having a first central passage, and a second tubular member located at the second end of the central section, the second tubular member having a second central passage, wherein the first tubular member is engaged with the first end piece and extends through the first end piece, and the second tubular member is engaged with the second end piece and extends through the second end piece, the mounting structure further comprising a first brace member connected to the first tubular member at a first location spaced inwardly from the first end piece and further connected to the central section to support the first tubular member and a second brace member connected to the second tubular member at a second location spaced inwardly from the second end piece and further connected to the central section to support the second tubular member;

a first barbell section comprising a first bar portion having a first sleeve mounted thereon, the first bar portion having a first proximal end received in the first central passage and connected to the first tubular member to connect the first barbell section to the first end of the central section; and a second barbell section comprising a second bar portion having a second sleeve mounted thereon, the second bar portion having a second proximal end received in the second central passage and connected to the second tubular member to connect the second barbell section to the second end of the central section.

2. The barbell of claim 1, wherein the barbell has a longitudinal axis defined between the first and second ends, and the plurality of frame members include a first longitudinal member and a second longitudinal member extending along the longitudinal axis on opposite lateral sides of the central section.

3. The barbell of claim 2, wherein the plurality of frame members further includes a first angled member extending from the first longitudinal member to the first end piece, a second angled member extending from the first longitudinal member to the second end piece, a third angled member extending from the second longitudinal member to the first end piece, a fourth angled member extending from the second longitudinal member to the second end piece, wherein the first, second, third, and fourth angled members are angled laterally and longitudinally inward from the first and second longitudinal members.

4. The barbell of claim 3, wherein the first brace member is connected to the first angled member and the third angled member, and the second brace member is connected to the second angled member and the fourth angled member.

5. The barbell of claim 2, wherein the first brace member is connected to the first and second longitudinal member.

6. The barbell of claim 1, wherein the first central passage extends from an inner end to an outer end of the first tubular member and the second central passage extends from an inner end to an outer end of the second tubular member.

7. The barbell of claim 6, wherein the first proximal end extends through the first central passage and is connected to a first removable fastener at the inner end of the first tubular member to removably connect the first bar portion to the first tubular member, and the second proximal end extends through the second central passage and is connected to a second removable fastener at the inner end of the second tubular member to removably connect the second bar portion to the second tubular member.

8. The barbell of claim 1, further comprising a plurality of grip members connected to the frame and configured for gripping by a user.

9. The barbell of claim 1, wherein the first tubular member extends through a first circular opening through the first end piece, and the second tubular member extends through a second circular opening through the second end piece.

10. The barbell of claim 1, wherein the first and second central passages each have a tapered inner diameter that decreases from an outer end toward an inner end thereof, and wherein the first bar portion is tapered to have a narrower diameter toward the first proximal end, and the second bar portion is tapered to have a narrower diameter toward the second proximal end.

11. The barbell of claim 1, wherein the plurality of frame members form a first side portion and a second side portion extending between the first and second ends of the central section, and wherein the first brace member is connected to the first side portion and the second side portion, and the second brace member is connected to the first side portion and the second side portion.

12. A barbell comprising:

a central section comprising a frame including a plurality of frame members extending between opposed first and second ends of the central section;

a mounting structure comprising a first tubular member located at the first end of the central section, the first tubular member having a first central passage, and a second tubular member located at the second end of the central section, the second tubular member having a second central passage, wherein the first and second central passages each have a tapered inner diameter that decreases from an outer end toward an inner end thereof;

a first barbell section comprising a first bar portion having a first sleeve mounted thereon, the first bar portion having a first proximal end received in the first central passage and connected to the first tubular member to connect the first barbell section to the first end of the central section, wherein the first bar portion is tapered to have a narrower diameter toward the first proximal end; and a second barbell section comprising a second bar portion having a second sleeve rotatably mounted thereon, the second bar portion having a second proximal end received in the second central passage and connected to the second tubular member to connect the second barbell section to the second end of the central section, wherein the second bar portion is tapered to have a narrower diameter toward the second proximal end, wherein the first central passage extends from the inner end to the outer end of the first tubular member and the second central passage extends from the inner end to the outer end of the second tubular member, and wherein the first proximal end extends through the first central passage and is connected to a first removable fastener at the inner end of the first tubular member to removably connect the first bar portion to the first tubular member, and the second proximal end extends through the second central passage and is connected to a second removable fastener at the inner end of the second tubular member to removably connect the second bar portion to the second tubular member.

13. The barbell of claim 12, wherein the central section further comprises a first end piece connected to the frame at the first end of the central section, and a second end piece connected to the frame at the second end of the central section, wherein the first tubular member is engaged with the first end piece, and the second tubular member is engaged with the second end piece.

14. The barbell of claim 13, wherein the first tubular member extends through the first end piece, and the second tubular member extends through the second end piece.

15. The barbell of claim 13, wherein the mounting structure further comprises a first brace member connected to the first tubular member at a first location spaced inwardly from the first end piece and further connected to the central section to support the first tubular member, and a second brace member connected to the second tubular member at a second location spaced inwardly from the second end piece and further connected to the central section to support the second tubular member.

16. The barbell of claim 12, further comprising a plurality of grip members connected to the frame and configured for gripping by a user.

17. The barbell of claim 12, wherein the first sleeve is rotatably mounted on the first bar portion, and the second sleeve is rotatably mounted on the second bar portion.

18. The barbell of claim 12, wherein the first bar portion is tapered to match the tapered inner diameter of the first central passage, and the second bar portion is tapered to match the tapered inner diameter of the second central passage.

19. The barbell of claim 12, wherein the barbell has a longitudinal axis defined between the first and second ends, and the plurality of frame members include a first longitudinal member and a second longitudinal member extending along the longitudinal axis on opposite lateral sides of the central section.

20. The barbell of claim 12, wherein the first proximal end of the first bar portion and the second proximal end of the second bar portion are threaded, and the first removable fastener and the second removable fastener are threadably engaged with the first proximal end and the second proximal end, respectively.

21. A barbell comprising:

a central section comprising a frame including a plurality of frame members forming a first side portion and a second side portion extending between opposed first and second ends of the central section, a first end piece connected to the frame at the first end of the central section, and a second end piece connected to the frame at the second end of the central section;

a mounting structure comprising a first tubular member located at the first end of the central section, the first tubular member having a first central passage extending from an inner end to an outer end thereof, and a second tubular member located at the second end of the central section, the second tubular member having a second central passage extending from an inner end to an outer end thereof, wherein the first tubular member is engaged with the first end piece and extends through the first end piece, and the second tubular member is engaged with the second end piece and extends through the second end piece, wherein the first and second central passages each have a tapered inner diameter that decreases from the outer end to the inner end thereof, the mounting structure further comprising first brace members each connected to the first tubular member at a first location spaced inwardly from the first end piece and further connected to the central section to support the first tubular member and second brace members each connected to the second tubular member at a second location spaced inwardly from the second end piece and further connected to the central section to support the second tubular member;

a first barbell section comprising a first bar portion having a first sleeve mounted thereon, the first bar portion having a first proximal end received in the first central passage and extending through the first central passage for connection and is connected to a first removable fastener to removably connect the first bar portion to the first tubular member, thereby connecting the first barbell section to the first end of the central section, wherein the first bar portion is tapered to have a narrower diameter toward the first proximal end and to match the tapered inner diameter of the first central passage;

a second barbell section comprising a second bar portion having a second sleeve mounted thereon, the second bar portion having a second proximal end received in the second central passage and extending through the second central passage and is connected to a second removable fastener to removably connect the second bar portion to the second tubular member, thereby connecting the second barbell section to the second end of the central section, wherein the second bar portion is tapered to have a narrower diameter toward the second proximal end and to match the tapered inner diameter of the first central passage; and a plurality of grip members connected to the frame and configured for gripping by a user.

22. The barbell of claim 21, wherein each of the plurality of grip members is connected to the first side portion and the second side portion of the frame and extends between the first and second side portions.

23. The barbell of claim 21, wherein the first brace members extend from the first tubular member to the first and second side portions of the frame, and the second brace members extend from the second tubular member to the first and second side portions.

24. The barbell of claim 21, wherein the first and second side portions of the frame each include a longitudinal frame member extending linearly along a longitudinal axis of the barbell.

25. The barbell of claim 21, wherein the frame has an arched configuration that arches upward from the first and second ends toward a longitudinal middle of the frame.

26. The barbell of claim 21, wherein the frame is configured as a trap bar.

27. A barbell comprising:

a central section comprising a frame including a plurality of frame members extending between opposed first and second ends of the central section;

a mounting structure comprising a first tubular member located at the first end of the central section, the first tubular member having a first central passage, and a second tubular member located at the second end of the central section, the second tubular member having a second central passage, wherein the first and second central passages each have a tapered inner diameter that decreases from an outer end toward an inner end thereof;

a first barbell section comprising a first bar portion having a first sleeve mounted thereon, the first bar portion having a first proximal end received in the first central passage and connected to the first tubular member to connect the first barbell section to the first end of the central section, wherein the first bar portion is tapered to have a narrower diameter toward the first proximal end; and a second barbell section comprising a second bar portion having a second sleeve rotatably mounted thereon, the second bar portion having a second proximal end received in the second central passage and connected to the second tubular member to connect the second barbell section to the second end of the central section, wherein the second bar portion is tapered to have a narrower diameter toward the second proximal end, wherein the central section further comprises a first end piece connected to the frame at the first end of the central section, and a second end piece connected to the frame at the second end of the central section, wherein the first tubular member is engaged with the first end piece, and the second tubular member is engaged with the second end piece, and wherein the first tubular member extends through the first end piece, and the second tubular member extends through the second end piece.

28. A barbell comprising:

a central section comprising a frame including a plurality of frame members extending between opposed first and second ends of the central section;

a mounting structure comprising a first tubular member located at the first end of the central section, the first tubular member having a first central passage, and a second tubular member located at the second end of the central section, the second tubular member having a second central passage, wherein the first and second central passages each have a tapered inner diameter that decreases from an outer end toward an inner end thereof;

a first barbell section comprising a first bar portion having a first sleeve mounted thereon, the first bar portion having a first proximal end received in the first central passage and connected to the first tubular member to connect the first barbell section to the first end of the central section, wherein the first bar portion is tapered to have a narrower diameter toward the first proximal end; and a second barbell section comprising a second bar portion having a second sleeve rotatably mounted thereon, the second bar portion having a second proximal end received in the second central passage and connected to the second tubular member to connect the second barbell section to the second end of the central section, wherein the second bar portion is tapered to have a narrower diameter toward the second proximal end, wherein the central section further comprises a first end piece connected to the frame at the first end of the central section, and a second end piece connected to the frame at the second end of the central section, wherein the first tubular member is engaged with the first end piece, and the second tubular member is engaged with the second end piece, and wherein the mounting structure further comprises a first brace member connected to the first tubular member at a first location spaced inwardly from the first end piece and further connected to the central section to support the first tubular member, and a second brace member connected to the second tubular member at a second location spaced inwardly from the second end piece and further connected to the central section to support the second tubular member.

* * * * *